US009457598B2

(12) United States Patent
Suda et al.

(10) Patent No.: US 9,457,598 B2
(45) Date of Patent: Oct. 4, 2016

(54) DIGITAL PRINTING APPARATUS

(71) Applicants: Hiroyuki Suda, Yamagata (JP); Satoshi Murakami, Ibaraki (JP); Kazuya Takahagi, Tokyo (JP); Masaharu Ito, Ibaraki (JP); Yasuhiro Suzuki, Yamagata (JP); Atsushi Saita, Ibaraki (JP); Hayato Kondo, Ibaraki (JP); Yuji Ishizuka, Ibaraki (JP)

(72) Inventors: Hiroyuki Suda, Yamagata (JP); Satoshi Murakami, Ibaraki (JP); Kazuya Takahagi, Tokyo (JP); Masaharu Ito, Ibaraki (JP); Yasuhiro Suzuki, Yamagata (JP); Atsushi Saita, Ibaraki (JP); Hayato Kondo, Ibaraki (JP); Yuji Ishizuka, Ibaraki (JP)

(73) Assignee: KOMORI CORPORATION, Tokyo (JP)

( * ) Notice: Subject to any disclaimer, the term of this patent is extended or adjusted under 35 U.S.C. 154(b) by 33 days.

(21) Appl. No.: 13/868,992

(22) Filed: Apr. 23, 2013

(65) Prior Publication Data

US 2013/0307893 A1 Nov. 21, 2013

(30) Foreign Application Priority Data

| | | |
|---|---|---|
| Apr. 24, 2012 | (JP) | 2012-098707 |
| Apr. 24, 2012 | (JP) | 2012-098722 |
| Apr. 25, 2012 | (JP) | 2012-099561 |
| Apr. 25, 2012 | (JP) | 2012-099565 |
| May 2, 2012 | (JP) | 2012-105257 |
| May 2, 2012 | (JP) | 2012-105382 |

(51) Int. Cl.

| | |
|---|---|
| ***B41J 13/22*** | (2006.01) |
| ***B41J 13/00*** | (2006.01) |
| ***B41J 3/60*** | (2006.01) |

(52) U.S. Cl.
CPC ..... *B41J 13/0009* (2013.01); *B41J 3/60* (2013.01); *B41J 13/223* (2013.01)

(58) Field of Classification Search
None
See application file for complete search history.

(56) References Cited

U.S. PATENT DOCUMENTS

| | | | | |
|---|---|---|---|---|
| 4,207,998 | A * | 6/1980 | Schmid | 226/95 |
| 4,237,466 | A | 12/1980 | Scranton | |
| 4,660,825 | A | 4/1987 | Umezawa | |
| 6,438,352 | B1 * | 8/2002 | Landa et al. | 399/401 |
| 2004/0083911 | A1 | 5/2004 | Fujiwara | |
| 2009/0290008 | A1 | 11/2009 | Fukui | |
| 2010/0294149 | A1 * | 11/2010 | Kusaka | 101/153 |
| 2012/0013693 | A1 | 1/2012 | Tasaka et al. | |

FOREIGN PATENT DOCUMENTS

| | | | |
|---|---|---|---|
| CN | 101941334 | A | 1/2011 |
| JP | S52-50806 | Y2 | 11/1977 |
| JP | H10323963 | A | 12/1998 |

(Continued)

*Primary Examiner* — Geoffrey Mruk
(74) *Attorney, Agent, or Firm* — Blakely Sokoloff Taylor & Zafman LLP

(57) ABSTRACT

A digital printing apparatus including a sheet supply device, printing cylinder, inkjet nozzle portion, sheet delivery device, and conveyance devices. The sheet supply device supplies sheets one by one at a predetermined period. The printing cylinder includes at least one gripper device that grips and holds the sheet, and conveys the sheet while one edge of the sheet supplied from the sheet supply device is held by the plurality of gripper devices. The inkjet nozzle portion discharges ink droplets onto the sheet. The conveyance devices include a plurality of gripper devices including one reversing gripper device that grips and holds the other edge of the sheet, and conveys the sheet printed on one surface, which is received from the printing cylinder in a double-sided printing mode. The sheet is turned by reversing the obverse/reverse surface of the sheet by the reversing gripper device in the process of conveyance.

3 Claims, 17 Drawing Sheets

(56) References Cited

FOREIGN PATENT DOCUMENTS

| | | | | |
|---|---|---|---|---|
| JP | 2001-113669 | A | 4/2001 | |
| JP | 2002-258716 | A | 9/2002 | |
| JP | 2002-331641 | A | 11/2002 | |
| JP | 2004-148726 | A | 5/2004 | |
| JP | 2007-196667 | A | 8/2007 | |
| JP | 2007238211 | A | 9/2007 | |
| JP | 2009-262537 | A | 11/2009 | |
| JP | 2010-221552 | A | 10/2010 | |
| JP | WO 2013/137057 | A1 * | 9/2013 | ..... B41J 2/01 |

* cited by examiner

DIGITAL PRINTING APPARATUS

BACKGROUND OF THE INVENTION

The present invention relates to a digital printing apparatus which prints on a sheet using the inkjet scheme.

Conventionally, as a digital printing apparatus which uses no plate, an inkjet printing apparatus which conveys a sheet-like recording medium onto the surface of a table, that moves in one direction, while the recording medium is mounted on it by grippers, and discharges ink from inkjet nozzles of four colors to record an image has been proposed, as disclosed in Japanese Patent Laid-Open No. 2009-262537.

In the above-mentioned conventional digital printing apparatus, the recording medium is horizontally conveyed through the table, and an image is recorded by the heads of inkjet nozzles arranged in series along the moving direction of the table. However, it is impossible to perform double-sided printing on the recording medium.

SUMMARY OF THE INVENTION

It is an object of the present invention to provide a digital printing apparatus capable of double-sided printing on a sheet with high front and back registration accuracy.

In order to achieve the above-mentioned object, according to the present invention, there is provided a digital printing apparatus comprising a sheet supply device which supplies sheets one by one at a predetermined period, a printing cylinder which includes at least one gripper device that grips and holds the sheet, and conveys the sheet while one edge of the sheet supplied from the sheet supply device is held by the plurality of gripper devices, an inkjet nozzle portion which discharges an ink droplet onto the sheet conveyed by the printing cylinder, and prints on the sheet, a sheet delivery device which discharges the sheet after end of printing by the inkjet nozzle portion, and conveyance devices which include a plurality of gripper devices including one reversing gripper device that grips and holds the other edge of the sheet, convey the sheet printed on one surface, which is received from the printing cylinder in a double-sided printing mode, while sequentially transferring the sheet by gripping changes by the plurality of gripper devices, and supply to the printing cylinder the sheet turned by reversing an obverse/reverse surface of the sheet by the reversing gripper device in the process of conveyance.

According to the present invention, since a sheet conveyance operation and reversal operation are performed by a gripping change only by a gripper device, it is possible to perform double-sided printing with high front and back registration accuracy. Also, since obverse printing and reverse printing are performed using the same printing cylinder, it is possible to attain a compact digital printing apparatus which performs high-quality double-sided printing on a sheet without increasing the size of the entire apparatus.

DESCRIPTION OF THE PREFERRED EMBODIMENTS

A printing press according to the present invention will be described in detail below with reference to the accompanying drawings.

<Arrangement of Digital Printing Apparatus>

Figure 1:
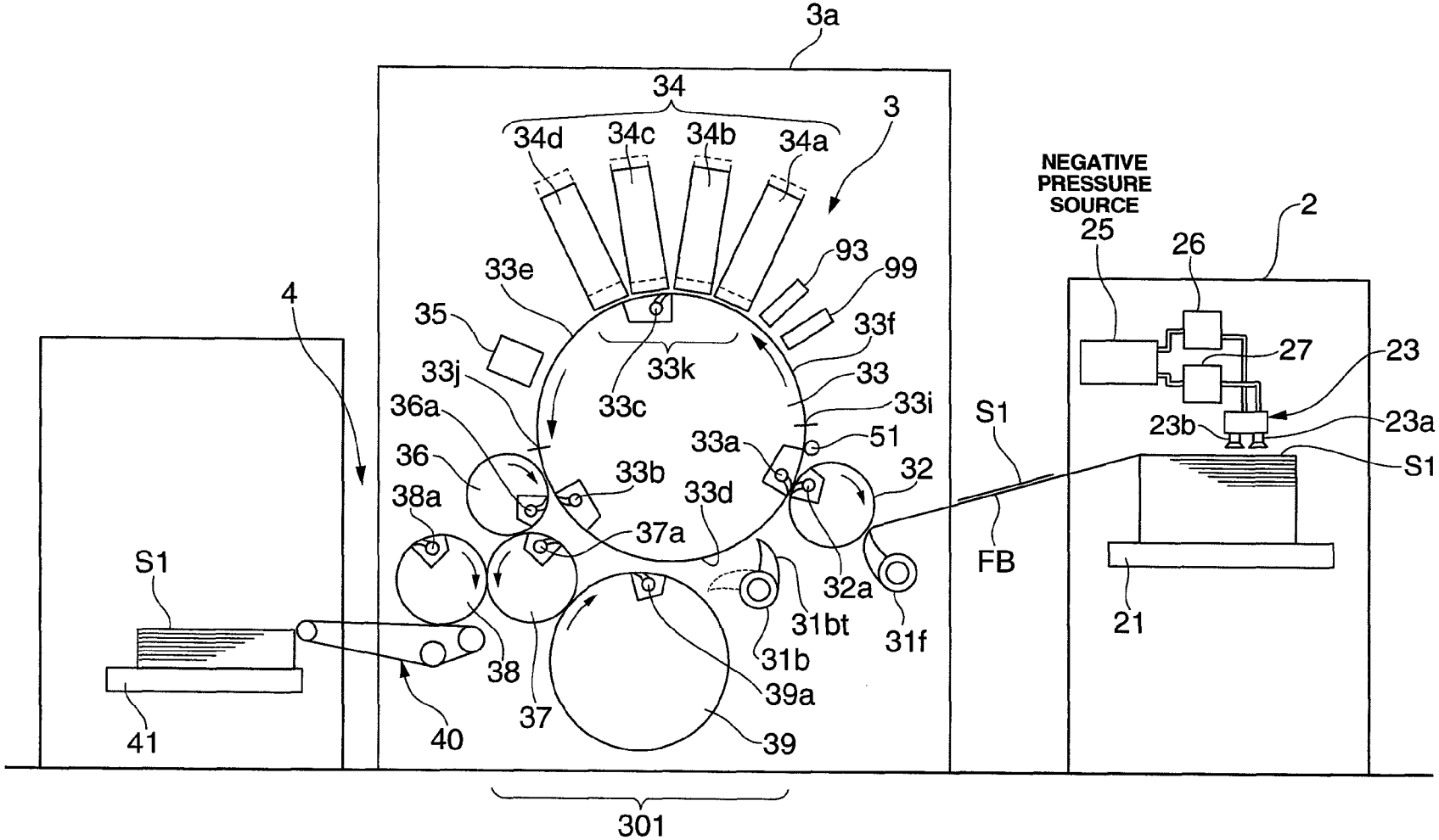
FIG. 1 is a side view showing the entire arrangement of a digital printing apparatus according to an embodiment of the present invention.

A digital printing apparatus 1 according to this embodiment includes a sheet feed device 2 serving as a sheet supply device, a digital printing unit 3 serving as a processing unit, and a sheet delivery device 4 serving as a sheet delivery device, as shown in FIG. 1.

The sheet feed device 2 includes a pile board 21 on which a plurality of sheets S1 are stacked, and a sucker device 23 which conveys the top sheet S1 on the pile board 21 onto a feeder board FB. The sucker device 23 includes a pair of suction ports 23*a* and 23*b*, which are connected to a negative pressure source 25 via a continuous supply valve 26 and an intermittent supply valve 27.

The continuous supply valve 26 and intermittent supply valve 27 enable/disable, at different timings, the suction operation of the suction ports 23*a* and 23*b* using a negative pressure from the negative pressure source 25.

A swing arm shaft pregripper 31*f* is disposed on the distal end side of the feeder board FB in the sheet conveyance direction. The swing arm shaft pregripper 31*f* is swingably supported on a frame 3*a* of the digital printing unit 3, and includes a gripper device (not shown) which grips and holds the leading edge (front edge) of the sheet S1 as its one edge. A feed-side transfer cylinder 32 is opposed to the swing arm shaft pregripper 31*f*, and rotatably supported on the frame 3*a*. A gripper device 32*a* which holds the leading edge of the sheet S1, transferred by a gripper device of the swing arm shaft pregripper 31*f*, in a gripped state is provided on the feed-side transfer cylinder 32. The swing arm shaft pregripper 31*f* and feed-side transfer cylinder 32 constitute an upstream sheet conveyance device. Note that in the following description, the gripper device is formed by a plurality of grippers aligned in the cylinder axis direction with predetermined gaps between them.

A printing cylinder 33 with a diameter three times that of the feed-side transfer cylinder 32 is opposed to the feed-side transfer cylinder 32 on the downstream side of the swing arm shaft pregripper 31*f* in the sheet conveyance direction to be in contact with the feed-side transfer cylinder 32, and is rotatably supported on the frame 3*a*. The printing cylinder 33 includes printing cylinder gripper devices 33*a*, 33*b*, and 33*c* which hold the leading edge of the sheet S1 upon receiving it from the gripper device 32*a* of the feed-side transfer cylinder 32, and support surfaces 33*d*, 33*e*, and 33*f* which are provided in correspondence with the printing cylinder gripper devices 33*a*, 33*b*, and 33*c*, and support the sheet S1. The printing cylinder 33 is implemented by a triple-diameter cylinder provided with three pairs of printing cylinder gripper devices 33*a*, 33*b*, and 33*c* and support surfaces 33*d*, 33*e*, and 33*f*. The printing cylinder gripper devices 33*a*, 33*b*, and 33*c* are provided at positions 120° out of phase with each other in the circumferential direction.

The printing cylinder 33 will be described next with reference to FIG. 7. A large number of suction holes 33*g* are formed in the entire support surfaces 33*d*, 33*e*, and 33*f* of the printing cylinder 33 to be connected to a negative pressure source (not shown). A gear 270 is fixed to one end of a shaft 33*h* of the printing cylinder 33 to be driven by a printing press driving motor (not shown).

The range of suction of the sheet S1 by the suction holes 33*g* in the printing cylinder 33 is defined from a suction start position 33*i* (FIG. 1) on the downstream side of the contact portion of the printing cylinder 33 with the feed-side transfer cylinder 32 in the sheet conveyance direction to a suction end position 33*j* (FIG. 1), and on the upstream side of the contact portion of the printing cylinder 33 with a delivery-side transfer cylinder 36 (to be described later) in the sheet conveyance direction. In this suction range, the entire surface of the sheet S1 is sucked by the support surfaces 33*d*, 33*e*, and 33*f* of the printing cylinder 33.

Referring back to FIG. 1, an inkjet nozzle portion 34 is opposed to the circumferential surface of the printing cylinder 33 on the downstream side of the contact portion of the printing cylinder 33 with the feed-side transfer cylinder 32 in the sheet conveyance direction.

The inkjet nozzle portion 34 includes a plurality of ink heads 34*a* to 34*d* (to be referred to as ink heads hereinafter) which are juxtaposed in the sheet conveyance direction along the circumferential surface of the printing cylinder 33, and store inks of different colors. Each of the ink heads 34*a* to 34*d* is oriented in a direction perpendicular to the circumferential surface of the printing cylinder 33. The ink heads 34*a* to 34*d* are arranged in proximity to the printing cylinder 33 to have small gaps with the sheet S1 having its leading edge sucked by the entire support surfaces 33*d*, 33*e*, and 33*f*. The printing cylinder 33 and inkjet nozzle portion 34 constitute a sheet printing device.

The structure of the inkjet nozzle portion 34 including a nozzle head moving device 260 will be described next with reference to FIGS. 7 to 10. Note that since the ink heads 34*a* to 34*d* have the same structure, the ink head 34*d* will be described representatively. A guide rail 281 is fixed to the frame 3*a* through a support member (not shown) to extend in the axial direction of the printing cylinder 33 at a position above the printing cylinder 33, and have one end extending to the exterior of the frame 3*a*, as shown in FIG. 7. Sliders 282 and 284 are slidably supported by the guide rail 281, and holders 283 and 285 are fixed to the sliders 282 and 284, respectively. The guide rail 281 and sliders 282 and 284 constitute a head slide device.

Stay bars ST1 and ST2 are fixed to the holders 283 and 285, respectively. Each of the stay bars ST1 and ST2 has one end which supports the corresponding one of cylinder bodies 276A and 278A of nozzle attaching/detaching devices (air cylinders) 276 and 278 serving as inkjet suction ports. The two ends of a support plate 34DP are fixed to piston rods 276B and 278B of the air cylinders 276 and 278, and the ink head 34*d* is supported by the support plate 34DP. Note that the ink heads 34*a* to 34*c* are supported by support plates 34AP to 34CP, respectively.

The ink head 34*d* is supported by the air cylinders 276 and 278 to be movable between a printing position (indicated by solid lines in FIGS. 1 and 7) at which it comes close to the circumferential surface of the printing cylinder 33, and a retreat position (indicated by broken lines in FIGS. 1 and 7) at which it retreats radially outside the printing cylinder 33 from the printing position. The ink head 34*d* is supported to be movable in the axial direction of the printing cylinder 33 along the guide rail 281 in the interval from the retreat position (FIG. 8) to the maintenance position (FIG. 9) outside the frame 3*a*.

Figure 8:
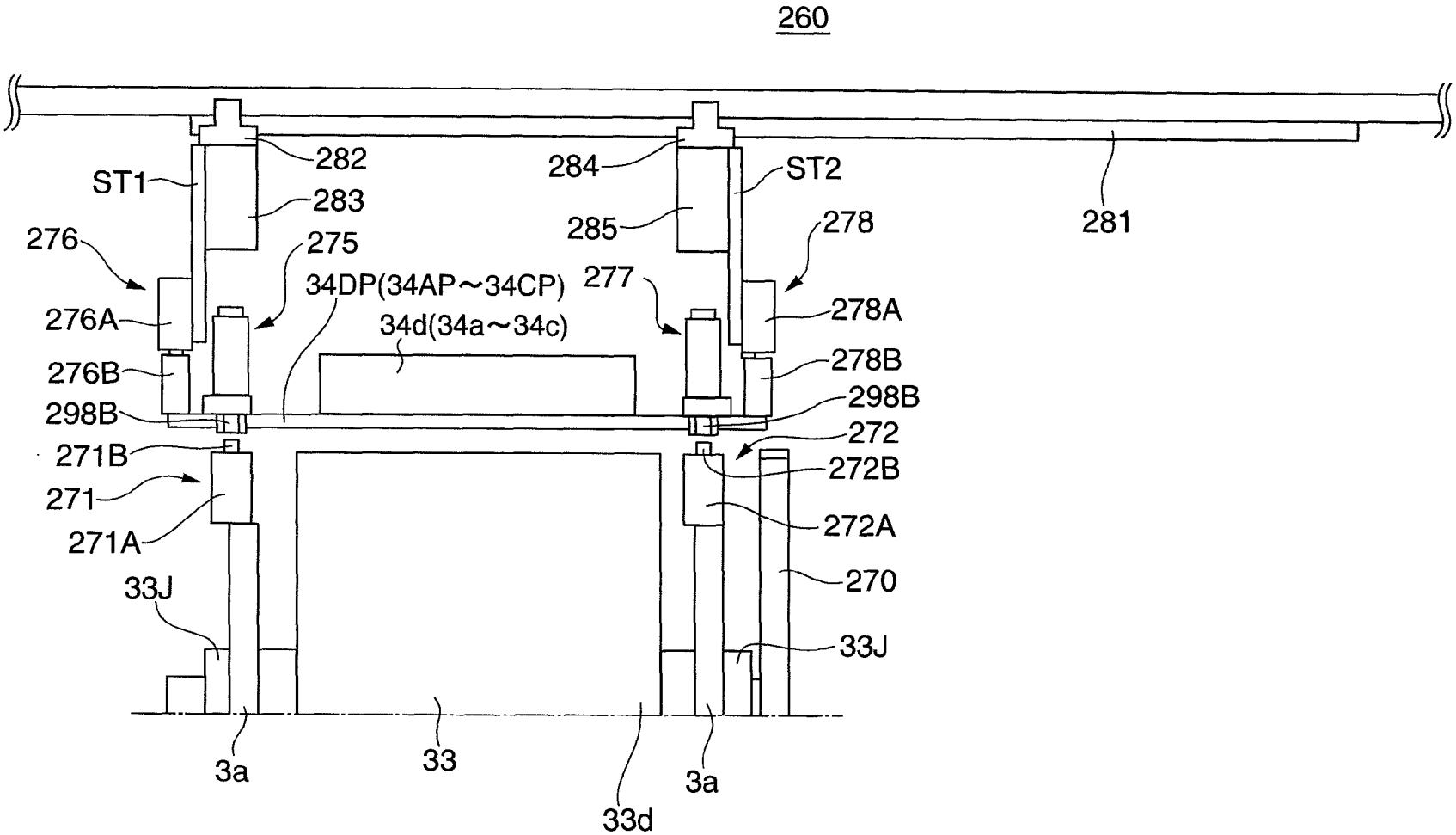
FIG. 8 is a view for explaining the attachment/detachment operation of the inkjet head portion shown in FIG. 7.
Figure 9:
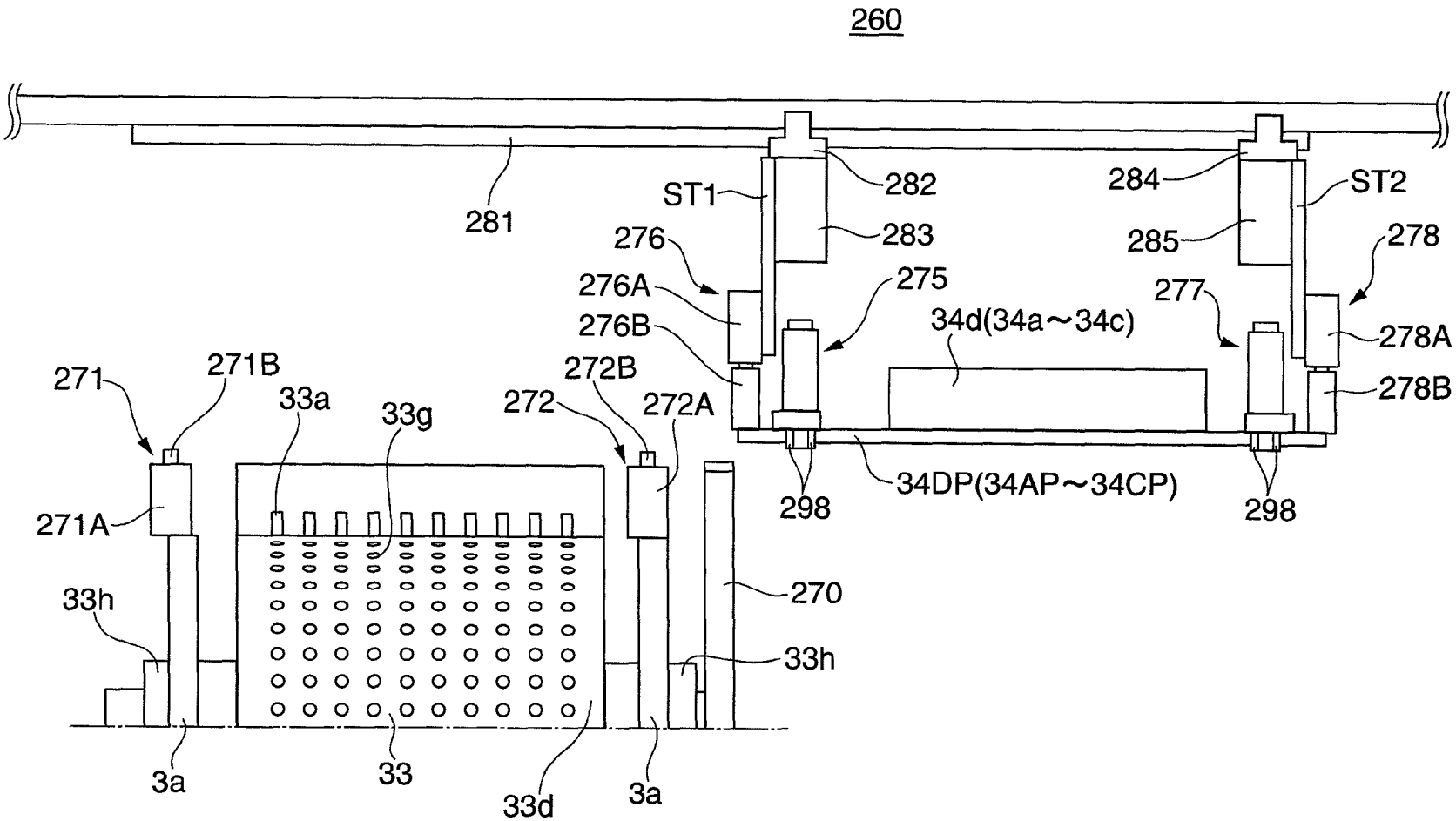
FIG. 9 is a view for explaining the slide operation of the inkjet head portion shown in FIG. 1.

Inkjet nozzle adjusting devices 275 and 277 which adjust the position of the ink head 34*d* with respect to the printing cylinder 33 at the printing position are provided at the two ends of the support plate 34DP, as shown in FIG. 8. Since the inkjet nozzle adjusting devices 275 and 277 have the same arrangement, only the inkjet nozzle adjusting device 275 will be described with reference to FIG. 10. Note that the head slide device (guide rail 281 and sliders 282 and 284), nozzle attaching/detaching devices (air cylinders 276 and 278), and inkjet nozzle adjusting devices 275 and 277 constitute the nozzle head moving device 260.

An outer peripheral wall 291B of a housing 291 is fixed to the support plate 34DP, and a ring-shaped internal threaded portion 297 having internal threads formed on its inner circumferential surface is fixed into the outer peripheral wall 291B. A holding plate 291A is fixed into the housing 291, while a motor 294 is fixed to the holding plate 291A. An external threaded portion 296 is fixed to one end of a motor shaft 294A of the motor 294 to rotate integrally with the motor shaft 294A, and is supported to move in the axial direction with rotation of the motor shaft 294A. The external threaded portion 296 threadably engages with an internal threaded portion 297, and has its distal end to which a first engaging member 298 having an engagement hole 298B is fixed.

A potentiometer 292 is attached to the upper end of a housing 291, and the other end of the potentiometer 292 is coupled to that of the motor shaft 294A of the motor 294 via a coupling 293.

Second engaging members 271 and 272 are attached to the upper end faces of a pair of frames 3*a*. The second engaging members 271 and 272 include main bodies 271A and 272A fixed to the frames 3*a*, and guide pins 271B and 272B inserted into the engagement holes 298B in the inkjet nozzle adjusting devices 275 and 277 while protruding from the upper end faces of the main bodies 271A and 272A by a predetermined amount. At this time, the upper end faces of the main bodies 271A and 272A and the outer circumferential surface of the printing cylinder 33 are set to be nearly flush with each other.

Referring back to FIG. 1, an ink drying lamp 35 is opposed to the printing cylinder 33. The ink drying lamp 35 serves as a drying device which is opposed to the printing cylinder 33 on the downstream side of a printing region 33K, printed by the inkjet nozzle portion 34 of the printing cylinder 33, in the sheet conveyance direction, and irradiates the sheet S1 with light such as infrared or ultraviolet rays to dry ink printed on the sheet S1. Note that drying includes applying thermal energy to the ink to evaporate the moisture of the ink, and curing the ink.

The printing cylinder 33 is arranged on the downstream side of the inkjet nozzle portion 34 in the sheet conveyance direction to be in contact with the delivery-side transfer cylinder 36 rotatably supported on the frame 3*a*. The delivery-side transfer cylinder 36 has a gripper device 36*a* which holds the leading edge of the sheet S1, conveyed by the printing cylinder 33, upon receiving it from the printing cylinder gripper devices 33*a*, 33*b*, and 33*c*.

Another delivery-side transfer cylinder 37 is arranged on the downstream side of the contact portion of the delivery-side transfer cylinder 36 with the printing cylinder 33 in the sheet conveyance direction to be in contact with the delivery-side transfer cylinder 36. The delivery-side transfer cylinder 37 is rotatably supported on the frame 3*a*. The delivery-side transfer cylinder 37 has a gripper device 37*a* which receives and holds the leading edge of the sheet S1 conveyed by the delivery-side transfer cylinder 36.

A delivery cylinder 38 is arranged on the downstream side of the contact portion of the delivery-side transfer cylinder 37 with the delivery-side transfer cylinder 36 in the sheet conveyance direction to be in contact with the delivery-side transfer cylinder 37. The delivery cylinder 38 is rotatably supported on the frame 3*a*. The delivery cylinder 38 has a gripper device 38*a* which receives and holds the leading edge of the sheet S1 conveyed by the delivery-side transfer cylinder 37.

A belt conveyor-shaped delivery belt 40 which conveys the sheet S1 is disposed below the delivery cylinder 38. A pile board 41 which stacks sheets S1 having undergone a digital printing process by the digital printing unit 3 is provided on the leading edge side of the delivery belt 40 in the sheet conveyance direction. The delivery cylinder 38, delivery belt 40, and pile board 41 constitute the sheet delivery device 4. Also, the path of the sheet S1 conveyed by the delivery cylinder 38 and delivery belt 40 constitutes a sheet discharge path.

A pre-reversal double-diameter cylinder 39 is arranged on the downstream side of the contact portion of the delivery-side transfer cylinder 37 with the delivery cylinder 38 in the sheet conveyance direction. The pre-reversal double-diameter cylinder 39 serves as a pre-reversal transport cylinder and is rotatably supported on the frame 3*a*. The pre-reversal double-diameter cylinder 39 is implemented by a double-diameter cylinder with a diameter twice that of the delivery-side transfer cylinder 37, and receives and holds the leading edge of the sheet S1 conveyed by the delivery-side transfer cylinder 37.

Figure 11:
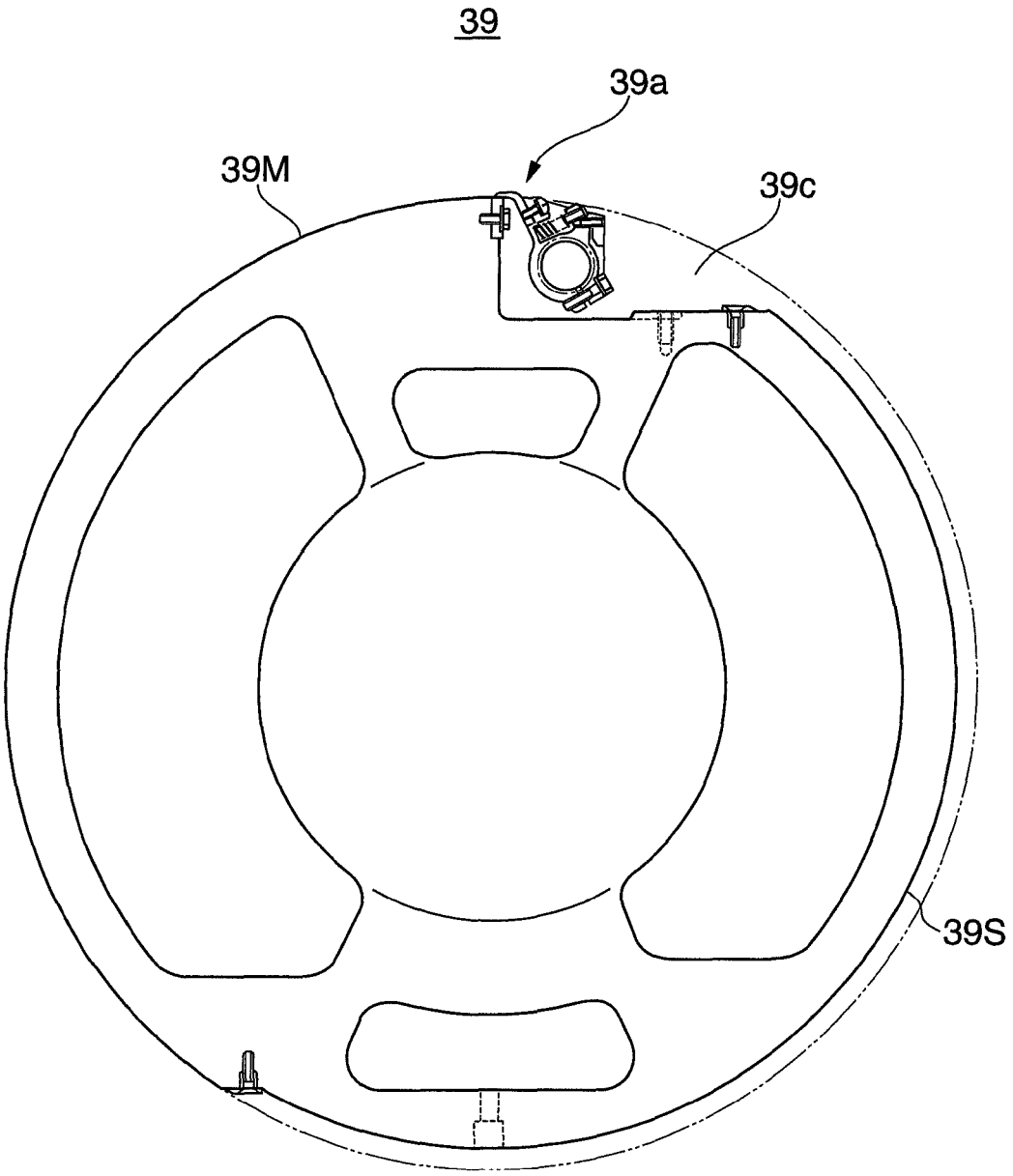
FIG. 11 is a side view of the printing cylinder shown in FIG. 1.

The circumferential surface of the pre-reversal double-diameter cylinder 39 is provided with a notch 39C which receives a gripper device 39*a*, an effective surface 39M which has a circumferential length slightly shorter than a half of its circumferential length and supports the sheet S1, and a small-diameter surface 39S which has a diameter smaller than that of the effective surface 39M, and a circumferential length slightly longer than a half of its circumferential length, as shown in FIG. 11. The effective surface 39M has a circumferential length longer than the maximum longitudinal dimension of the sheet S1, that can be printed by the digital printing apparatus 1.

Figure 12:
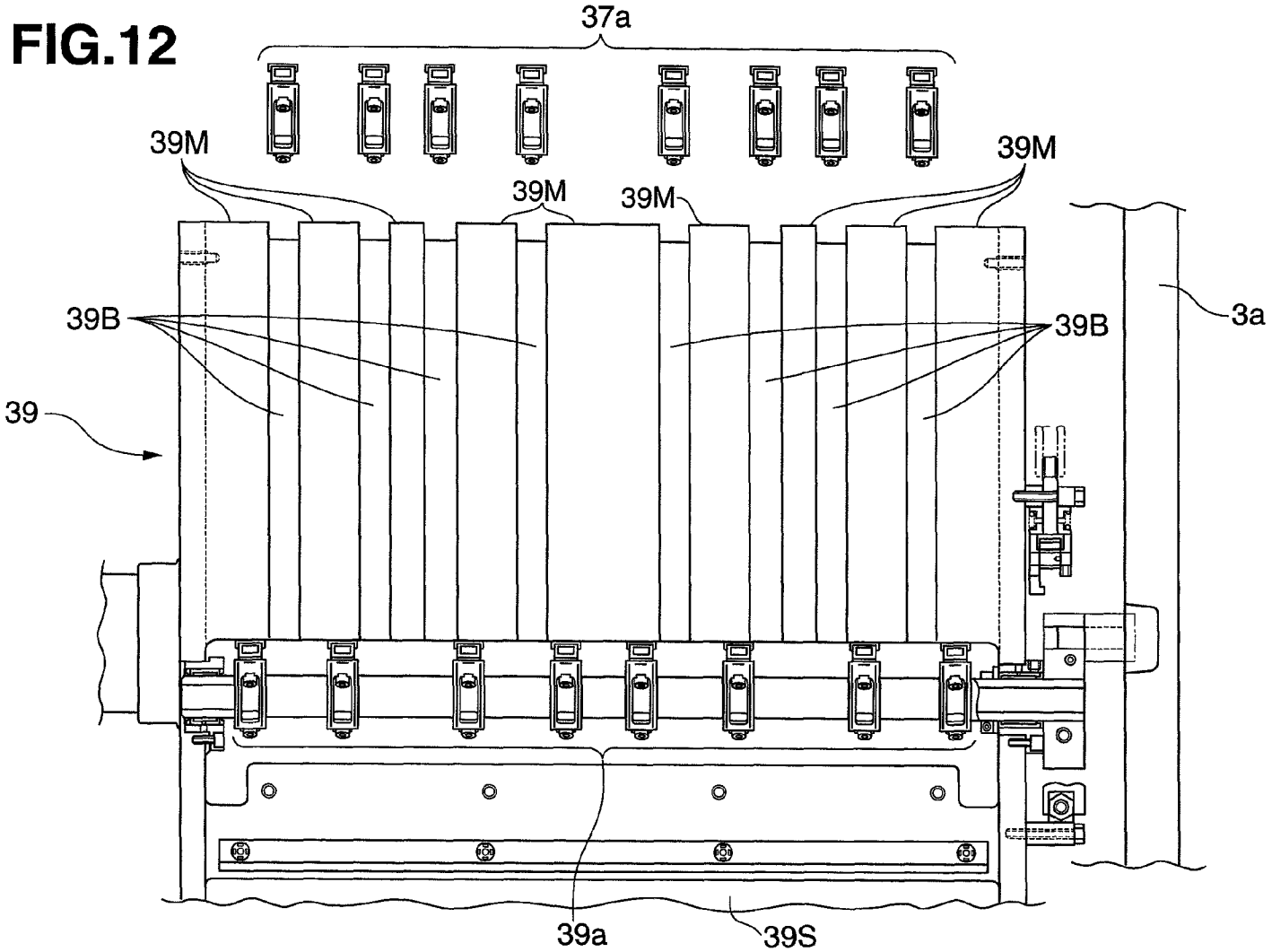
FIG. 12 is a front view of the printing cylinder shown in FIG. 11.

A plurality of grooves 39B are formed in the effective surface 39M of the pre-reversal double-diameter cylinder 39 in the axial direction of the pre-reversal double-diameter cylinder 39 to extend throughout the circumferential length of the effective surface 39M, as shown in FIG. 12. The grooves 39B are provided at positions opposite to the gripper device 37*a* of the delivery-side transfer cylinder 37, and a reversing gripper device 31*bt* of a reversing swing arm shaft pregripper 31*b* (to be described later). The grooves 39B allow the notch 39C and small-diameter surface 39S to communicate with each other along the outer circumference of the pre-reversal double-diameter cylinder 39. The grooves 39B, notch 39C, and small-diameter surface 39S constitute an interference preventive portion which prevents the gripper device 37*a* and reversing gripper device 31*bt* from interfering with the pre-reversal double-diameter cylinder 39 throughout the circumferential length of the pre-reversal double-diameter cylinder 39.

Figure 2:
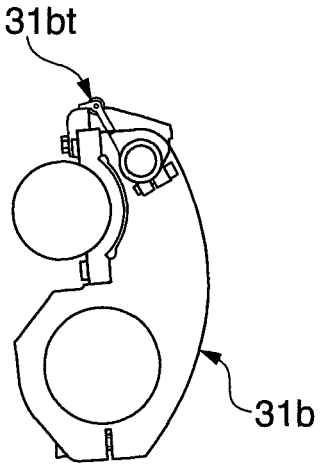
FIG. 2 is a side view of a reversing gripper device shown in FIG. 1.

The reversing swing arm shaft pregripper 31*b* having the reversing gripper device 31*bt* which receives and holds the trailing edge (rear edge) of the sheet S1 as its other edge is opposed to the pre-reversal double-diameter cylinder 39 on the downstream side of the contact portion of the pre-reversal double-diameter cylinder 39 with the delivery-side transfer cylinder 37 in the sheet conveyance direction, as shown in FIG. 2. The reversing swing arm shaft pregripper 31*b* is opposed to the printing cylinder 33 on the downstream side of the contact portion of the printing cylinder 33 with the delivery-side transfer cylinder 36 in the rotation direction of the printing cylinder 33, and on the upstream side of the contact portion of the printing cylinder 33 with the feed-side transfer cylinder 32 in the rotation direction of the printing cylinder 33. The reversing swing arm shaft pregripper 31*b* is supported on the frame 3*a* to be swingable between a reception position (a broken line in FIG. 2) at which it receives the trailing edge of the sheet S1 conveyed by the pre-reversal double-diameter cylinder 39, and a transfer position (a solid line in FIG. 2) at which it transfers by a gripping change the trailing edge of the sheet S1 to the printing cylinder gripper devices 33*a*, 33*b*, and 33*c* of the printing cylinder 33.

Note that the delivery-side transfer cylinders 36 and 37, pre-reversal double-diameter cylinder 39, and reversing swing arm shaft pregripper 31*b* constitute a sheet conveyance device 301 which conveys the sheet S1. The reversing gripper device and reversing swing arm shaft pregripper 31*b* constitute a sheet reversing portion which turns the sheet S1. The path of the sheet S1 conveyed by the delivery-side transfer cylinders 36 and 37, pre-reversal double-diameter cylinder 39, and reversing swing arm shaft pregripper 31*b* constitute a sheet reversal path.

The gripper device 37*a* of the delivery-side transfer cylinder 37 is driven to selectively transfer by a gripping change the sheet S1 between the gripper device 38*a* of the delivery cylinder 38 and the gripper device 39*a* of the pre-reversal double-diameter cylinder 39. Also, the gripper device 38*a* of the delivery cylinder 38 is driven to selectively receive the leading edge of the sheet S1 conveyed by the delivery-side transfer cylinder 37. The gripper devices 37*a* and 38*a* constitute a conveyance path switching device 82 (FIG. 3) which switches the conveyance destination of the sheet S1 to the sheet delivery device 4 or reversing swing arm shaft pregripper 31*b*, that is, switches the conveyance destination of the sheet S1 to the sheet discharge path or the sheet reversal path.

Figure 13:
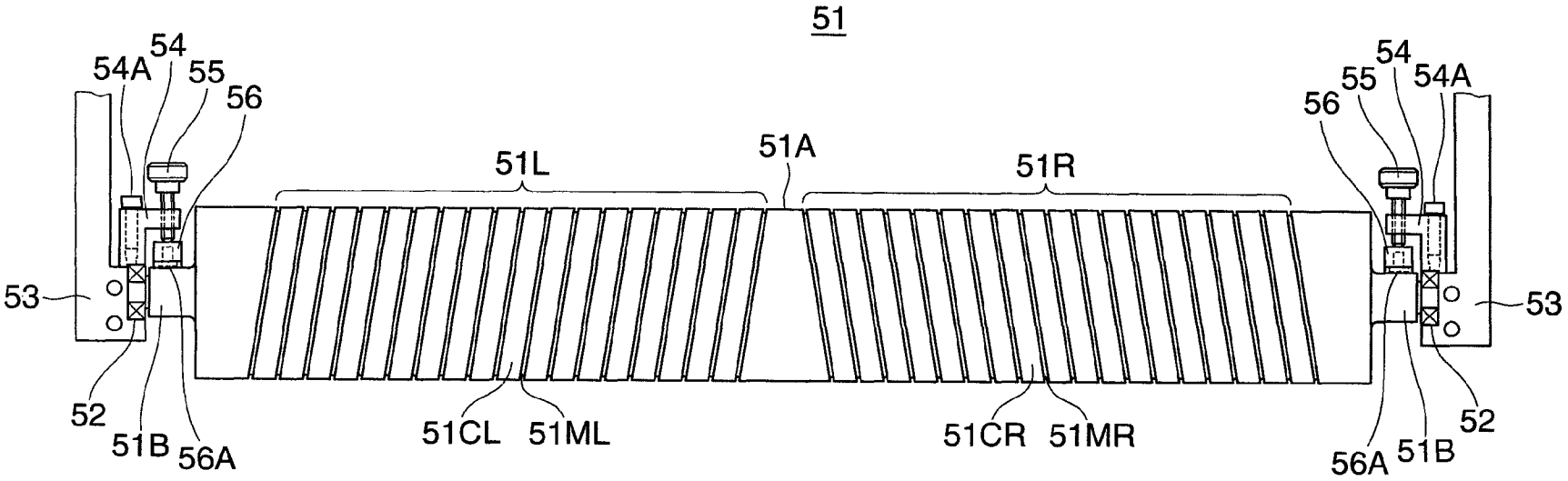
FIG. 13 is a front view of a spreading roller shown in FIG. 1.
Figure 14:
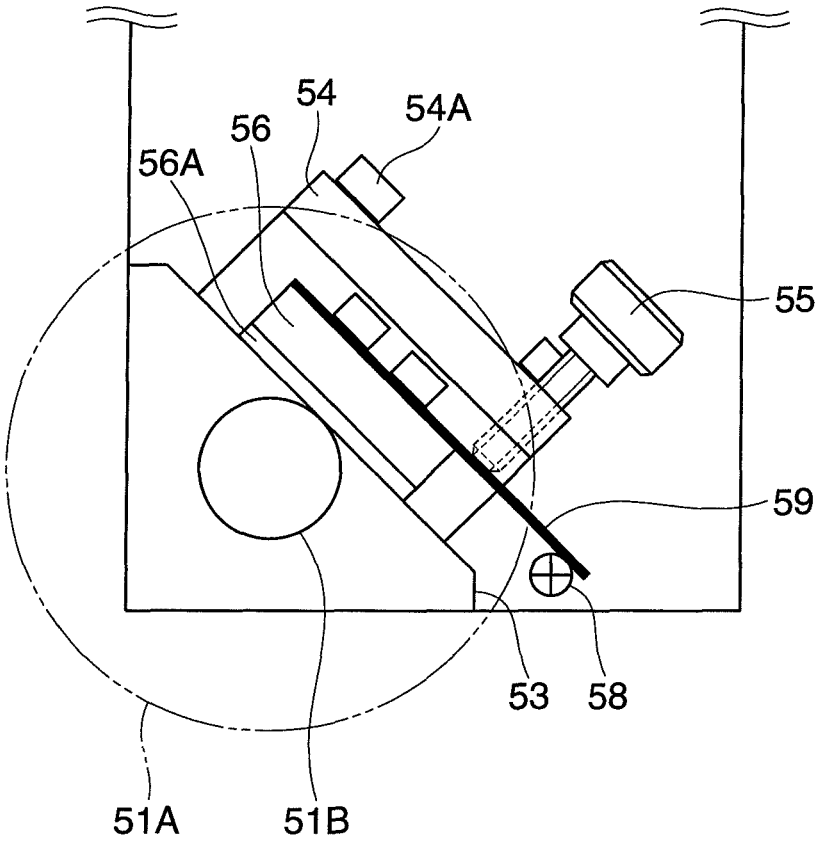
FIG. 14 is a schematic side view of a braking device which brakes the spreading roller shown in FIG. 13.

A smoothing roller will be described next. A smoothing roller 51 serving as a spreading roller which presses the sheet S1 is opposed to the circumferential surface of the printing cylinder 33 on the downstream side of the contact portion of the printing cylinder 33 with the feed-side transfer cylinder 32 in the sheet conveyance direction. The smoothing roller 51 is pivotally supported by a pair of fixing members 53 supported by a pair of frames, as shown in FIG. 13. A holder 54 is fastened to the fixing member 53 by a bolt 54A, and a knobbed adjusting bolt 55 threadably engages with the holder 54, as shown in FIG. 14.

A pin 58 is provided on the fixing member 53, and supports the proximal end of a leaf spring 59 equipped with a brake plate 56 including a brake shoe 56A. The leaf spring 59 is pressed by the distal end of the knobbed adjusting bolt 55, so the brake shoe 56A presses the circumferential surface of a shaft portion 51B of the smoothing roller 51. With this operation, a braking force acts on the smoothing roller 51 rotated by the sheet S1 conveyed with rotation of the printing cylinder 33. The brake plate 56, brake shoe 56A, leaf spring 59, pin 58, knobbed adjusting bolt 55, and holder 54 constitute a braking force applying device.

The circumferential surface of the smoothing roller 51 is formed by rubber, and constitutes a smoothing portion 51L on one end side (left side) from the center, and a smoothing portion 51R on the other end side (right side) from the center, as shown in FIG. 13. A spiral recessed portion 51ML is formed in the smoothing portion 51L, and a spiral projecting portion 51CL is formed by the recessed portion 51ML. Also, a spiral recessed portion 51MR is formed in the smoothing portion 51R, and a spiral projecting portion 51CR is formed by the recessed portion 51MR.

A sheet conveyance failure detection device 99 is opposed to the circumferential surface of the printing cylinder 33 on the downstream side of the contact portion of the printing cylinder 33 with the feed-side transfer cylinder 32 in the sheet conveyance direction, and on the upstream side of the printing region 33K printed by the inkjet nozzle portion 34 in the sheet conveyance direction. The sheet conveyance failure detection device 99 detects a conveyance failure such as a float or bend of the sheet S1, conveyed by the printing cylinder 33, from the printing cylinder 33.

The sheet conveyance failure detection device 99 is implemented by a photoelectric sensor which detects the distance from the sheet S1 conveyed by the printing cylinder 33, and outputs the detection result to a control device 80 (to be described later). The control device 80 determines a conveyance failure due to bending or wrinkling of the sheet S1 if the distance detected by the sheet conveyance failure detection device 99 is smaller than a preset threshold.

A sheet presence/absence detection device 93 which detects the presence/absence of the sheet S1 on the printing cylinder 33 is opposed to the circumferential surface of the printing cylinder 33 on the downstream side of the contact portion of the printing cylinder 33 with the feed-side transfer cylinder 32 in the sheet conveyance direction, and on the upstream side of the printing region 33K, printed by the inkjet nozzle portion 34, in the sheet conveyance direction.

The sheet presence/absence detection device 93 is implemented by a photoelectric sensor which detects the presence/absence of the sheet S1 at the timing at which the printing cylinder gripper devices 33*a* to 33*c* of the printing cylinder 33 pass through it, or that at which it is opposed to the support surfaces 33*d* to 33*f*, and outputs the detection result to the control device 80. The control device 80 controls the ink drying lamp 35 based on the detection result obtained by the sheet presence/absence detection device 93.

<Configuration of Control System for Digital Printing Apparatus>

Figure 3:
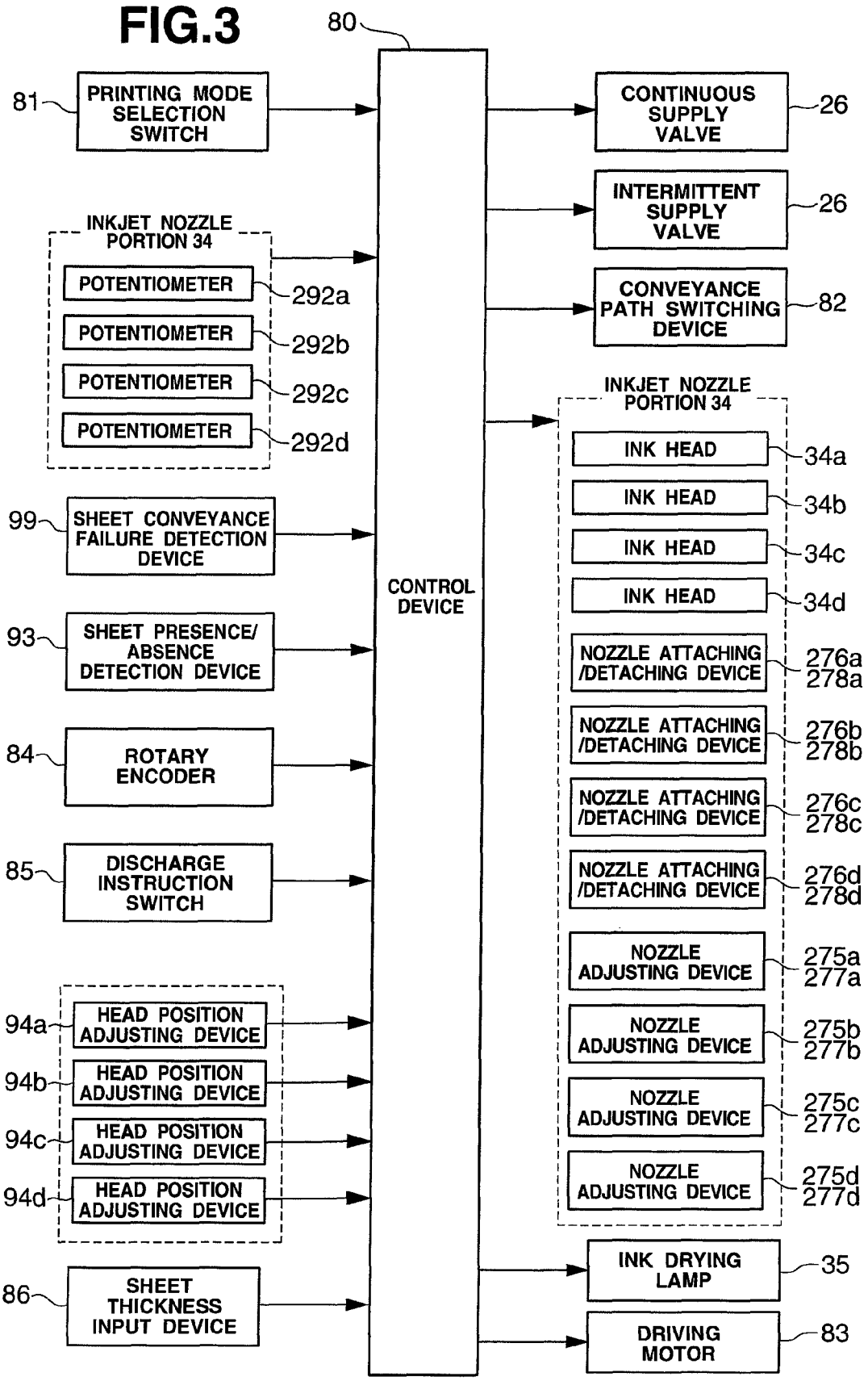
FIG. 3 is a block diagram showing the configuration of a control system for the digital printing apparatus shown in FIG. 1.
Figure 4:
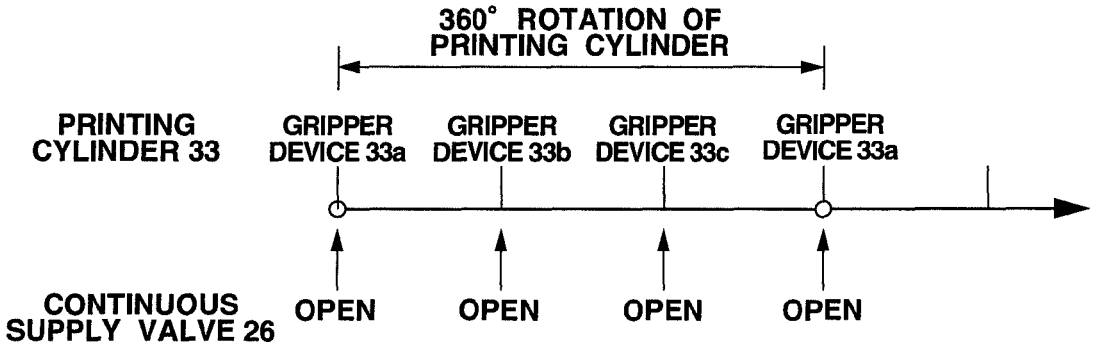
FIG. 4 is a timing chart for explaining continuous sheet feed in the digital printing apparatus shown in FIG. 1.

The digital printing apparatus 1 includes the control device 80 having a CPU (Central Processing Unit) configuration for overall control, as shown in FIG. 3. The control device 80 is connected to the continuous supply valve 26, the intermittent supply valve 27, the inkjet nozzle portion 34, the ink drying lamp 35, a printing mode selection switch 81 which allows the operator to select one of a single-sided printing mode in which a digital printing process is performed only on one side of the sheet S1, and a double-sided printing mode in which a digital printing process is performed on both the obverse and reverse surfaces of the sheet S1, the conveyance path switching device 82 (delivery-side transfer cylinder 37 and gripper devices 37*a*, 38*a*, and 39*a*), a driving motor 83 which rotates the printing cylinder 33, a rotary encoder 84 serving as a phase detection device which detects the phase of the printing cylinder 33, a discharge instruction switch 85 which instructs to discharge the sheet S1 supplied from the digital printing apparatus 1 onto the pile board 41 of the sheet delivery device 4, a sheet thickness input device 86 which receives the thickness of the sheet S1 upon input by the operator or detection by the detector, the sheet presence/absence detection device 93, and the sheet conveyance failure detection device 99.

Figure 7:
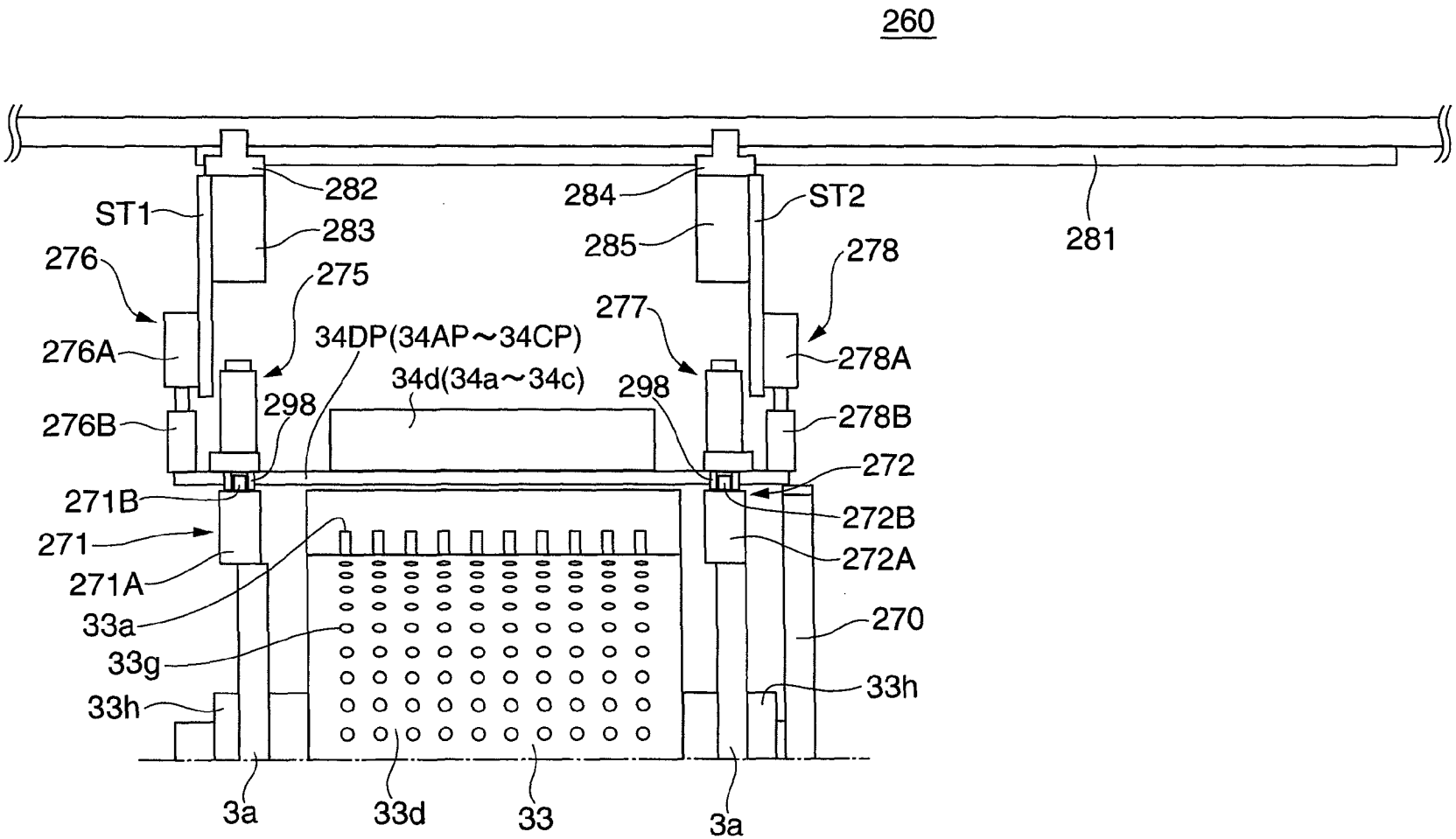
FIG. 7 is a front view showing the structure of an inkjet head portion shown in FIG. 1.
Figure 10:
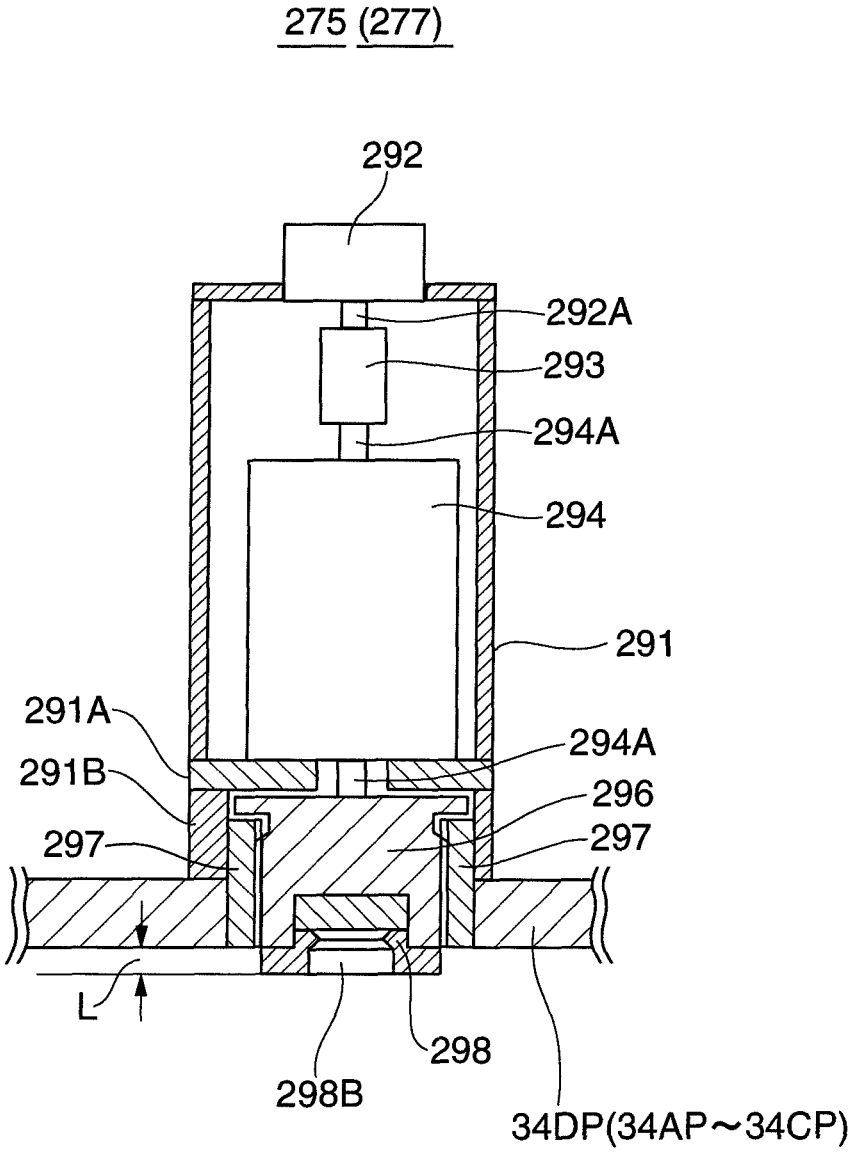
FIG. 10 is a sectional view showing an inkjet nozzle adjusting device shown in FIG. 7.

The inkjet nozzle portion 34 includes not only the ink heads 34*a* to 34*d* shown in FIG. 1, but also nozzle attaching/detaching devices (air cylinders) 276 and 278, that is, 276*a*, 278*a*, 276*b*, 278*b*, 276*c*, 278*c*, 276*d*, and 278*d* and potentiometers 292, that is, 292*a* to 292*d*, the head position (gap) adjusting device 294, that is, 294*a* to 294*d* shown in FIG. 10, and the inkjet nozzle adjusting devices 275 and 277, that is, 275*a*, 277*a*, 275*b*, 277*b*, 275*c*, 277*c*, 275*d*, and 277*d* shown in FIG. 7.

<Printing Operation of Digital Printing Apparatus>

The printing operation of the digital printing apparatus 1 configured as mentioned above will be described separately for the case wherein the single-sided printing mode is selected and that wherein the double-sided printing mode is selected.

When the single-sided printing mode is selected by operating the control device 80 by the operator, the control device 80 actuates the continuous supply valve 26. With this operation, the suction ports 23*a* and 23*b* suck the sheet S1 on the pile board 21, and convey it onto the feeder board FB, as shown in FIG. 1.

The continuous supply valve 26 opens every time the same number of sheets S1 as the numbers of printing cylinder gripper devices 33*a*, 33*b*, and 33*c* of the printing cylinder 33 are supplied during 360° rotation of the printing cylinder 33, that is, at each timing (period) at which the printing cylinder gripper devices 33*a*, 33*b*, and 33*c* in the printing cylinder 33, and the gripper device 32*a* of the feed-side transfer cylinder 32 are opposed to each other. As the continuous supply valve 26 opens, a negative pressure is supplied from the negative pressure source 25 to the suction ports 23*a* and 23*b* to perform suction. Supply of the sheet S1 so that all the printing cylinder gripper devices 33*a*, 33*b*, and 33*c* of the printing cylinder 33 grip the sheet S1 will be referred to as continuous sheet feed hereinafter. Also, the period at which the continuous supply valve 26 opens/closes in continuous sheet feed will be referred to as a first period hereinafter. With this operation, the sucker device 23 conveys the sheet S1 onto the feeder board FB at the first period.

The leading edge of the sheet S1 conveyed by the feeder board FB is held by the gripper device of the swing arm shaft pregripper 31*f*, and the sheet S1 is conveyed onto the feed-side transfer cylinder 32 upon a swing of the swing arm shaft pregripper 31*f*. The leading edge of the sheet S1 conveyed onto the feed-side transfer cylinder 32 is transferred by a gripping change to the gripper device 32*a* of the feed-side transfer cylinder 32.

The leading edge of the sheet S1 conveyed with rotation of the feed-side transfer cylinder 32 is transferred by a gripping change from the gripper device 32*a* of the feed-side transfer cylinder 32 to either of the printing cylinder gripper devices 33*a*, 33*b*, and 33*c* of the printing cylinder 33, and the sheet S1 is conveyed with rotation of the printing cylinder 33. In the printing cylinder 33, a suction force acts on the suction holes 33*g* on the downstream side in the rotation direction from the suction start position 33*i*, so the entire surface of the sheet S1 is sucked to and brought into tight contact with the support surfaces 33*d*, 33*e*, and 33*f* as the sheet S1 passes through the suction start position 33*i*.

A digital printing process is performed on the obverse surface of the sheet S1 conveyed by the printing cylinder 33 by discharging minute drops of ink from the ink heads 34*a* to 34*d* of the inkjet nozzle portion 34. The sheet S1 is brought into tight contact with the support surface of the printing cylinder 33, and is therefore conveyed while minute intervals with the ink heads 34*a* to 34*d* are maintained. Ink discharged while these minute intervals are maintained can be adhered to the sheet S1 with high accuracy, thereby allowing high-quality printing. The ink on the sheet S1 printed by the inkjet nozzle portion 34 dries with light emitted by the ink drying lamp 35 when the sheet S1 passes between the printing cylinder 33 and the ink drying lamp 35. The sheet S1 is then conveyed onto the delivery-side transfer cylinder 36.

Since the sheet S1 is in tight contact with the support surfaces 33*d*, 33*e*, and 33*f* of the printing cylinder 33 in the suction range from the suction start position 33*i* to the suction end position 33*j*, the entire surface of the sheet S1 is uniformly irradiated with light from the ink drying lamp 35 to perform uniform ink drying.

Figure 5A:
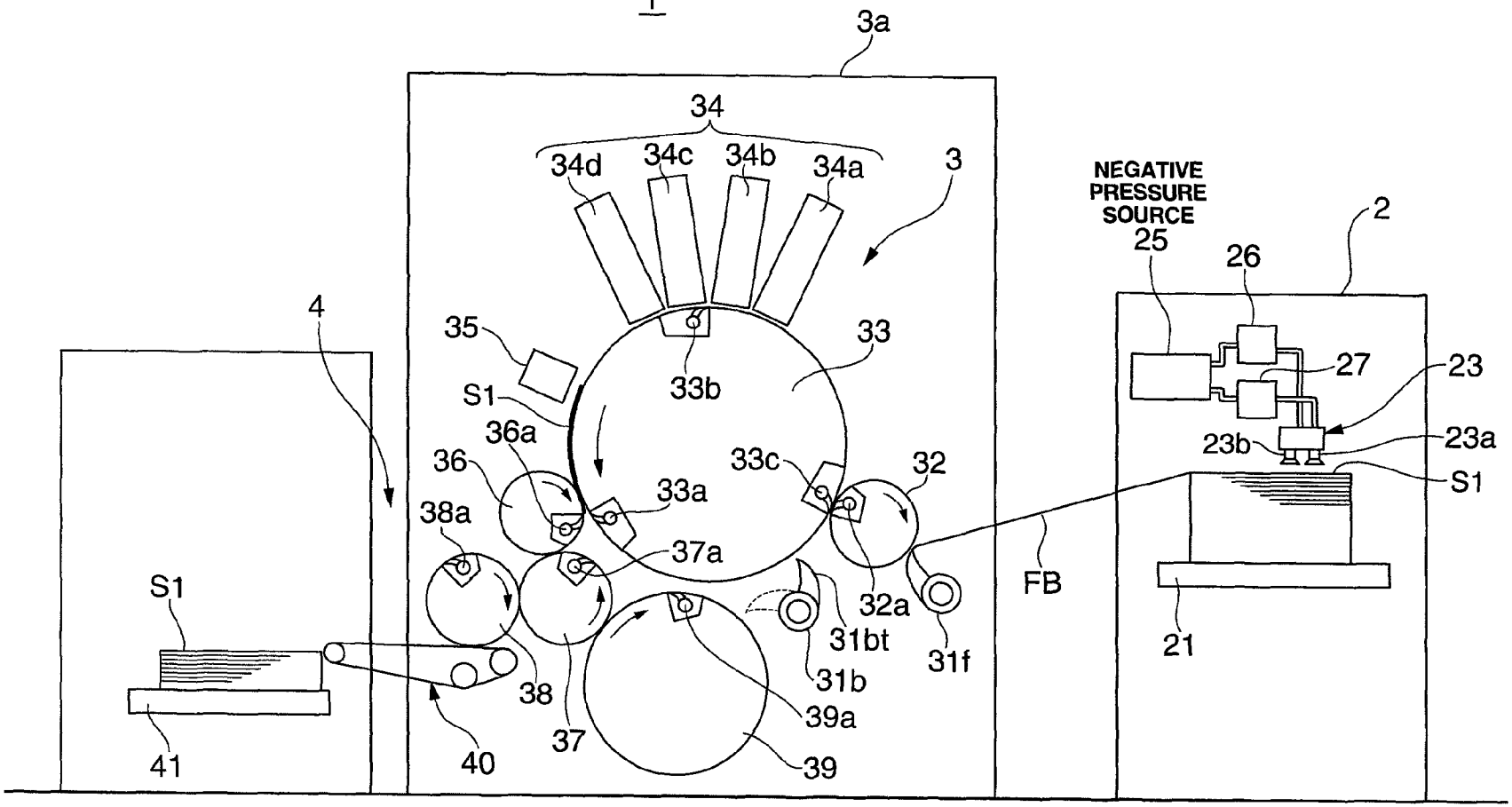
FIGS. 5A to 5E are side views showing double-sided printing processes (1) to (5) in the digital printing apparatus shown in FIG. 1.
Figure 5B:
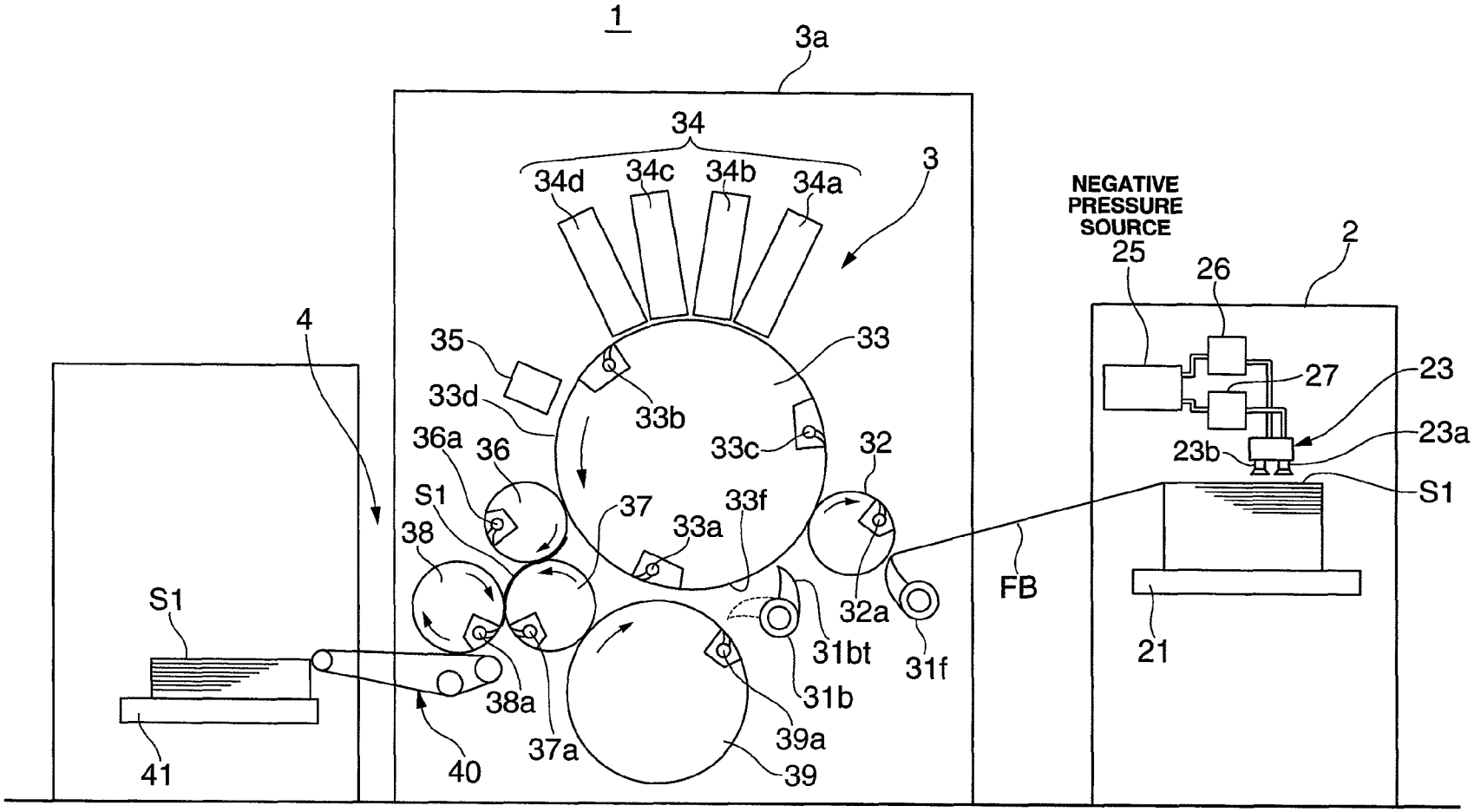

In the contact portion between the printing cylinder 33 and the delivery-side transfer cylinder 36, the leading edge of the sheet S1 is transferred by a gripping change from the printing cylinder gripper devices 33*a* to 33*c* of the printing cylinder 33 to the gripper device 36*a* of the delivery-side transfer cylinder 36, as shown in FIG. 5A. At this time, the leading edge of the sheet S1 passes through the suction end position 33*j*, so no suction force acts from the suction holes 33*g*. This makes it possible to easily peel the sheet S1 off the support surfaces 33*d*, 33*e*, and 33*f* to allow a smooth gripping change. Then, the leading edge of the sheet S1 held by the gripper device 36*a* of the delivery-side transfer cylinder 36 is transferred by a gripping change from the gripper device 36*a* of the delivery-side transfer cylinder 36 to the gripper device 37*a* of the delivery-side transfer cylinder 37 in the contact portion between the delivery-side transfer cylinders 36 and 37, as shown in FIG. 5B.

In the single-sided printing mode, the control device 80 controls the conveyance path switching device 82 to transfer all sheets S1 from the delivery-side transfer cylinder 37 onto the delivery cylinder 38 based on a phase signal from the rotary encoder 84. That is, in the phase in which the leading edge of the sheet S1 is positioned in the contact portion between the delivery-side transfer cylinders 37 and 38, the gripper device 37*a* of the delivery-side transfer cylinder 37 cancels holding of the leading edge of the sheet S1, and the gripper device 38*a* of the delivery cylinder 38 is held while gripping the leading edge of the sheet S1 at the same time. With this operation, the sheet S1 printed on its one surface is transferred from the delivery-side transfer cylinder 37 onto the delivery cylinder 38, and conveyed.

Holding, by the gripper device 38*a*, of the sheet S1 transferred onto the delivery cylinder 38 is canceled at the timing at which the gripper device 38*a* of the delivery cylinder 38 is positioned above the delivery belt 40, and is placed on the delivery belt 40.

The sheet S1 placed on the delivery belt 40 is conveyed as the delivery belt 40 travels, and the sheet S1 having undergone a digital printing process on its obverse surface is discharged onto the delivery belt 40 of the sheet delivery device 4.

On the other hand, when the double-sided printing mode is selected by the operation of the operator, the control device 80 actuates the intermittent supply valve 27. With this operation, the sheet S1 on the pile board 21 is sucked by the suction ports 23*a* and 23*b*, and conveyed onto the feeder board FB.

Figure 6:
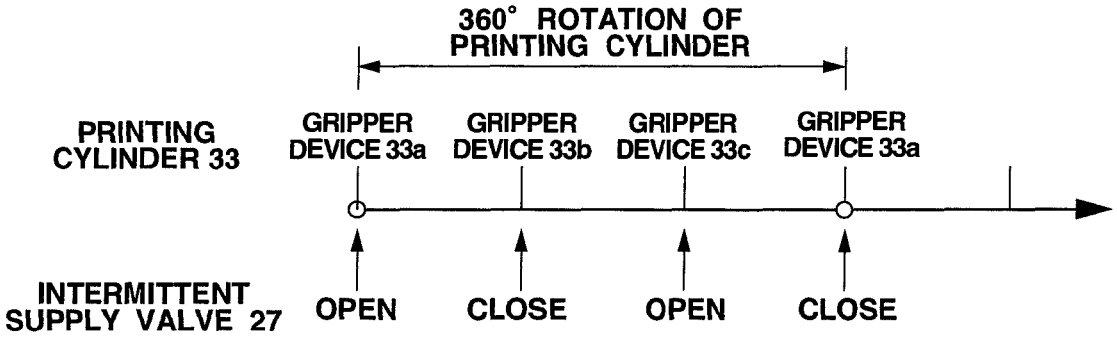
FIG. 6 is a timing chart for explaining intermittent sheet feed in the digital printing apparatus shown in FIG. 1.

At this time, the intermittent supply valve 27 is controlled at the timing at which the sheets S1 are alternately supplied so as to open, close, open, close, . . . , at the timing of continuous supply, that is, the timing (period) at which the printing cylinder gripper devices 33*a*, 33*b*, and 33*c* of the printing cylinder 33, and the gripper device 32*a* of the feed-side transfer cylinder 32 are opposed to each other, as shown in FIG. 6. This period is twice that of continuous supply. In this manner, supply of the sheet S1 so that the printing cylinder gripper devices 33*a*, 33*b*, and 33*c* of the printing cylinder 33 alternately grip the sheet S1 will be referred to as intermittent sheet feed hereinafter, and the period at which the intermittent supply valve 27 opens/closes in intermittent sheet feed will be referred to as a second period hereinafter. With this operation, the sucker device 23 conveys the sheet S1 onto the feeder board FB at the second period.

The sheet S1 fed onto the feeder board FB by the sucker device 23 is transferred onto the printing cylinder 33 through the swing arm shaft pregripper 31*f* and feed-side transfer cylinder 32 in the same way as in the single-sided printing mode. At this time, since the sheet S1 is fed at the timing of intermittent sheet feed, the printing cylinder gripper devices 33*a* to 33*c* of the printing cylinder 33 receive the sheet S1 alternately conveyed from the feed-side transfer cylinder 32.

The sheet S1 transferred onto the printing cylinder 33 is conveyed to the inkjet nozzle portion 34, and obverse surface printing is performed on one surface (obverse surface). Note that the control device 80 prints on the sheet S1 alternately held by the printing cylinder gripper devices 33*a* to 33*c* of the printing cylinder 33, based on a phase signal from the rotary encoder 84. On the other hand, the ink heads 34*a* to 34*d* of the inkjet nozzle portion 34 are controlled so as not to print on the support surfaces 33*d* to 33*f* corresponding to the printing cylinder gripper devices 33*a* to 33*c* which do not hold the sheet S1.

For double-sided printing, the control device 80 controls the conveyance path switching device 82 so that the sheet S1 printed on its obverse surface by the inkjet nozzle portion 34 is transferred onto the pre-reversal double-diameter cylinder 39 without transferring it from the delivery-side transfer cylinder 37 onto the delivery cylinder 38.

More specifically, in conveyance path switching control, in the phase in which the sheet S1 which is printed on its obverse surface and has undergone no digital print process on its other surface (reverse surface) is positioned in the contact portion between the delivery-side transfer cylinder 37 and the delivery cylinder 38, the grippers of the gripper device 37*a* of the delivery-side transfer cylinder 37 are kept closed without opening to maintain the state in which the gripper device 37*a* holds the leading edge of the sheet S1. At this time, the grippers of the gripper device 38*a* of the delivery cylinder 38 are kept open without closing. With this operation, the sheet S1 printed only on its obverse surface continues to be conveyed by the delivery-side transfer cylinder 37 without a gripping change to the delivery cylinder 38.

Figure 5C:
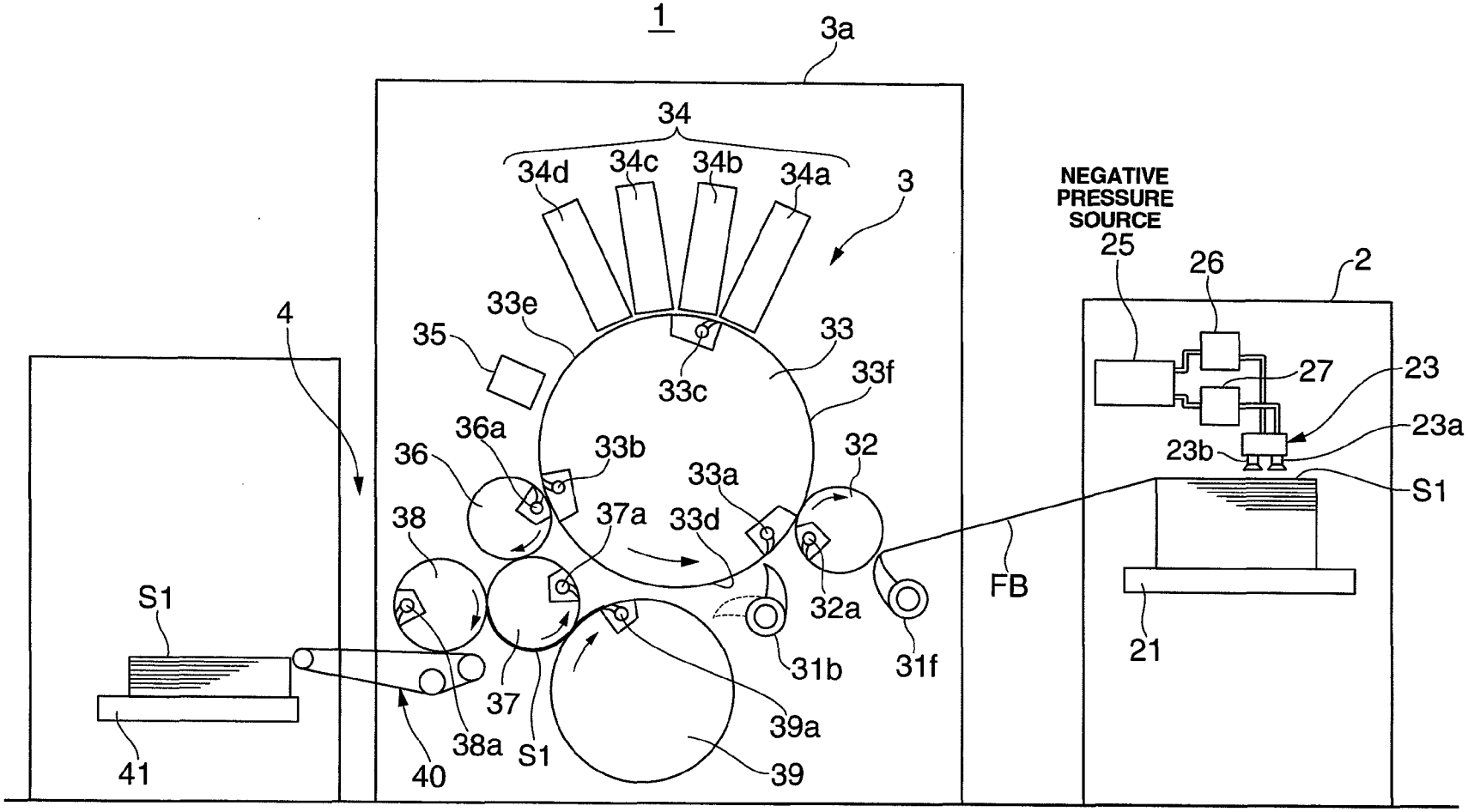

The leading edge of the sheet S1 conveyed by the delivery-side transfer cylinder 37 is held by closing the grippers of the gripper device 39*a* of the pre-reversal double-diameter cylinder 39 in the contact portion between the delivery-side transfer cylinder 37 and the pre-reversal double-diameter cylinder 39. At the same time, holding of the leading edge of the sheet S1 is canceled by opening the grippers of the gripper device 37*a* of the delivery-side transfer cylinder 37. With this operation, the leading edge of the sheet S1 is transferred by a gripping change from the gripper device 37*a* of the delivery-side transfer cylinder 37 to the gripper device 39*a* of the pre-reversal double-diameter cylinder 39, as shown in FIG. 5C.

Figure 5D:
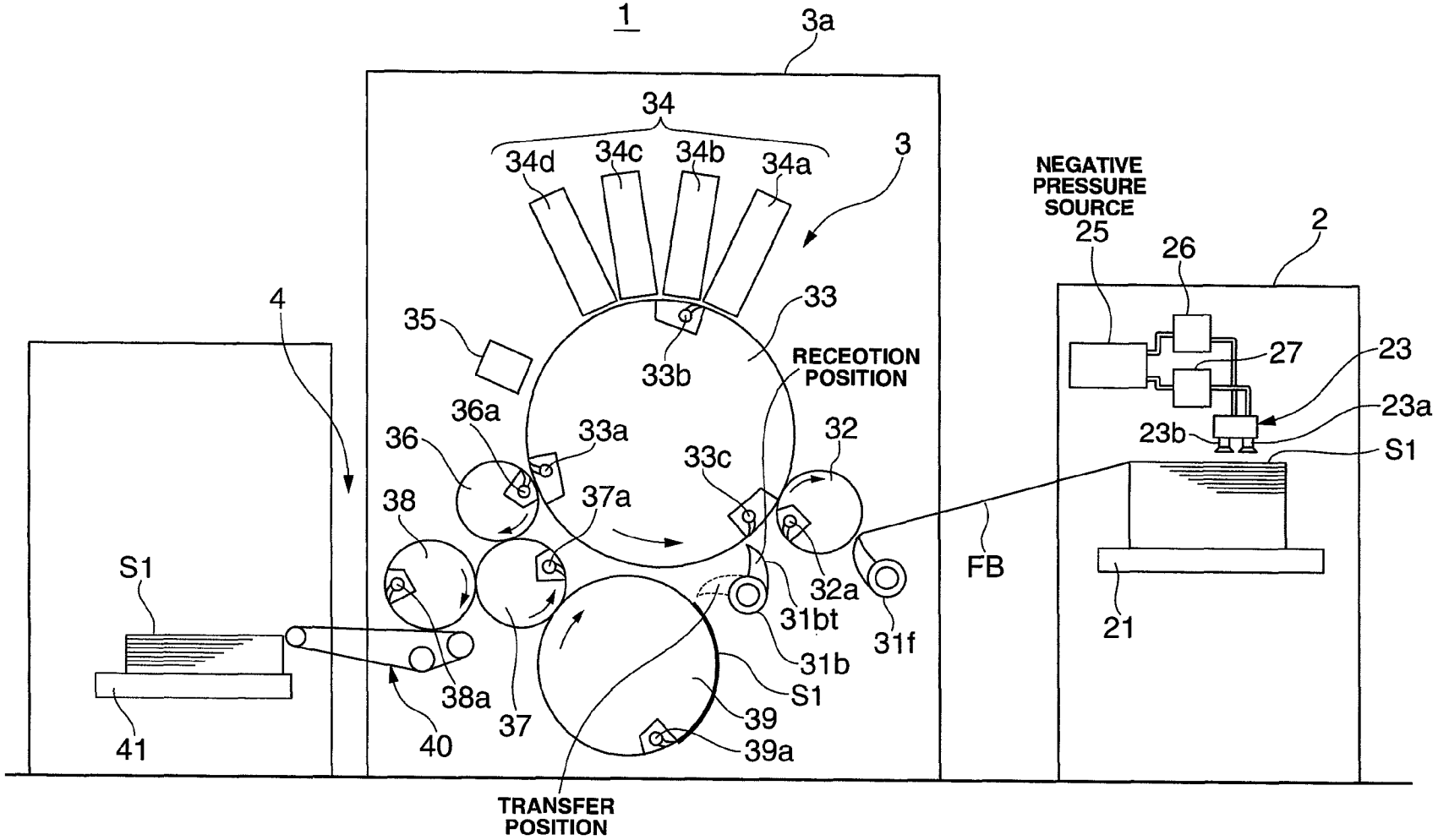

The sheet S1 conveyed with rotation of the pre-reversal double-diameter cylinder 39 is conveyed with rotation of the pre-reversal double-diameter cylinder 39, as shown in FIG. 5D. As the reversing swing arm shaft pregripper 31*b* swings from the transfer position (solid line) to the reception position (broken line), the trailing edge of the sheet S1 during conveyance is held by the reversing gripper device 31*bt* of the reversing swing arm shaft pregripper 31*b*. At the same time, holding of the leading edge of the sheet S1 by the gripper device 39*a* of the pre-reversal double-diameter cylinder 39 is canceled. With this operation, the sheet S1 is transferred by a gripping change from the gripper device 39*a* of the pre-reversal double-diameter cylinder 39 to the reversing gripper device 31*bt* of the reversing swing arm shaft pregripper 31*b*.

The pre-reversal double-diameter cylinder 39 is provided with the notch 39C which receives the pre-reversal double-diameter cylinder 39, the effective surface 39M which supports the sheet S1, and the small-diameter surface 39S with a diameter smaller than that of the effective surface 39M, as shown in FIG. 11. Hence, the sheet S1 received from the delivery-side transfer cylinder 37 is supported and conveyed by the effective surface 39M of the pre-reversal double-diameter cylinder 39 from the leading edge to the trailing edge. Also, the trailing edge of the sheet S1 is transferred by the reversing gripper device 31*bt* of the reversing swing arm shaft pregripper 31*b* while being supported by the effective surface 39M. With this operation, a gripping change is reliably performed by the reversing gripper device 31*bt* with high registration accuracy.

Interference between the effective surface 39M of the pre-reversal double-diameter cylinder 39, and the gripper device 37*a* of the delivery-side transfer cylinder 37 and the reversing gripper device 31*bt* of the reversing swing arm shaft pregripper 31*b* is prevented by the grooves 39B formed in the effective surface 39M, the notch 39C, and the small-diameter surface 39S, as shown in FIG. 12. This prevents damage to the cylinders and the gripper devices.

Figure 5E:
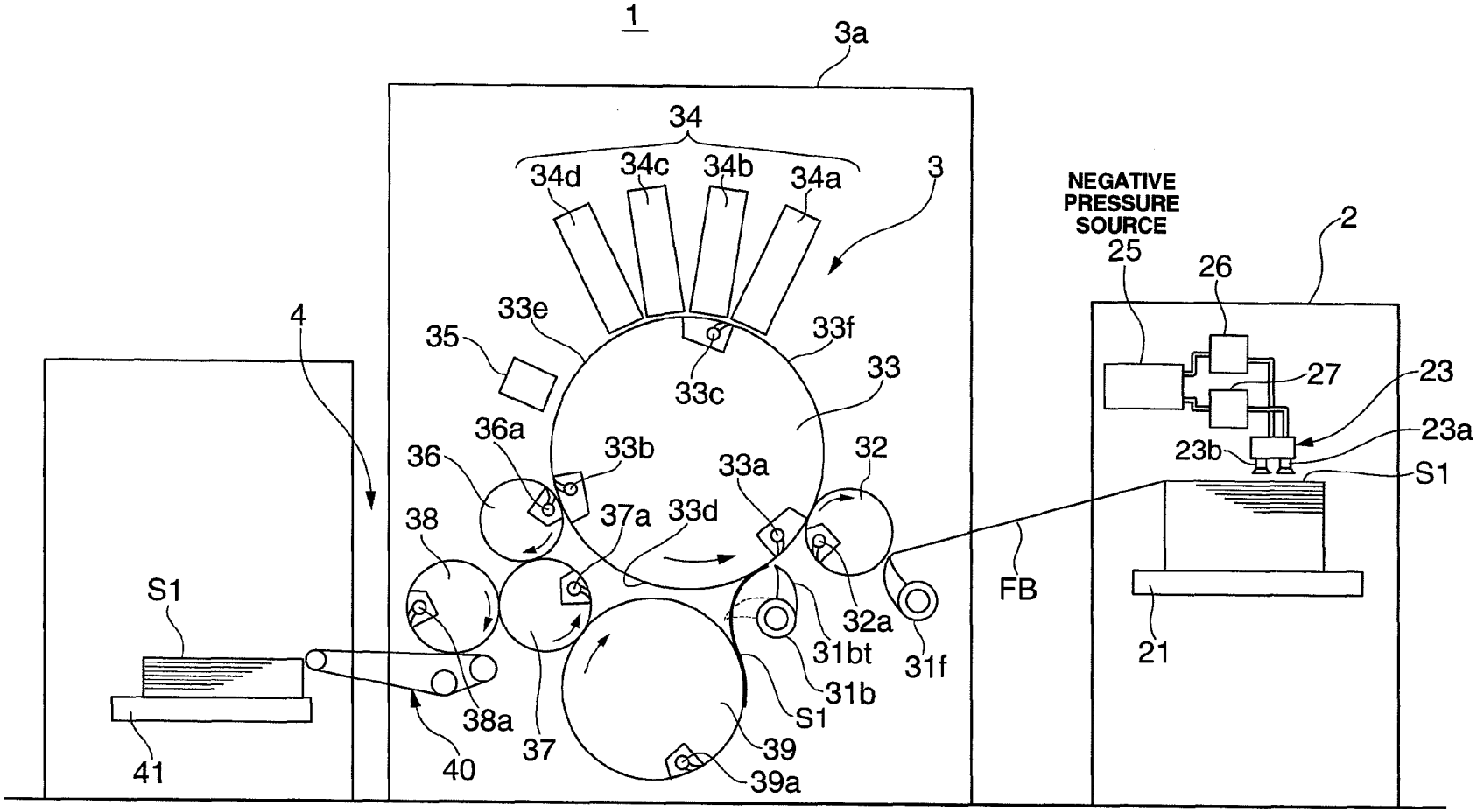

The sheet S1 transferred by a gripping change to the reversing gripper device 31*bt* of the reversing swing arm shaft pregripper 31*b* is conveyed onto the printing cylinder 33 with its trailing edge leading as it swings from the reception position (broken line) to the transfer position (solid line) of the reversing gripper device 31*bt*, as shown in FIG. 5E. The trailing edge of the sheet S1 is transferred by a gripping change from the reversing gripper device 31*bt* of the reversing swing arm shaft pregripper 31*b* to either of the printing cylinder gripper devices 33*a* to 33*c* of the printing cylinder 33 in a turned state.

At this time, the printing cylinder gripper devices 33*a* to 33*c* of the printing cylinder 33 alternately hold a new sheet S1 conveyed from the feed-side transfer cylinder 32. The reversing swing arm shaft pregripper 31*b* is positioned at the transfer position at the timing at which it is opposed to the printing cylinder gripper devices 33*a* to 33*c* which hold no new sheet S1, and the trailing edge of the sheet S1 is transferred from the reversing gripper device 31*bt* to the printing cylinder gripper devices 33*a* to 33*c*. With this operation, a new sheet S1 transferred from the feed-side transfer cylinder 32, and a sheet S1 transferred from the reversing gripper device 31*bt* and turned (having its obverse surface printed) are alternately held by the printing cylinder gripper devices 33*a* to 33*c* of the printing cylinder 33, and are conveyed to the inkjet nozzle portion 34.

The sheet S1 transferred from the reversing gripper device 31*bt* of the reversing swing arm shaft pregripper 31*b* has an obverse surface (a surface having undergone a digital printing process) having already undergone a digital printing process by the inkjet nozzle portion 34, which comes into contact with the support surfaces 33*d*, 33*e*, and 33*f* of the printing cylinder 33. Therefore, while the reverse surface of the sheet S1 (a surface having undergone no digital printing process) is exposed, the trailing edge of the sheet S1 is conveyed while being held by the printing cylinder gripper devices 33*a* to 33*c* of the printing cylinder 33. That is, the sheet S1 printed on its obverse surface is turned and conveyed, and a digital printing process is performed on its reverse surface by the inkjet nozzle portion 34.

The control device 80 performs reverse printing on the sheet S1 which is transferred from the reversing gripper device 31*bt* of the reversing swing arm shaft pregripper 31*b* and turned, based on a phase signal from the rotary encoder 84. On the other hand, the ink heads 34*a* to 34*d* of the inkjet nozzle portion 34 are controlled to perform obverse printing on the new sheet S1 alternately held by the printing cylinder gripper devices 33*a* to 33*c* of the printing cylinder 33. With this operation, the ink heads 34*a* to 34*d* alternately perform obverse printing and reverse printing in correspondence with the new sheet S1 and turned sheet S1 alternately held by the printing cylinder 33.

The sheet S1 having undergone reverse printing on its reverse surface is discharged from the delivery belt 40 onto the pile board 41 sequentially through the delivery-side transfer cylinders 36 and 37, and delivery cylinder 38, as in the single-sided printing mode.

Position adjustment of the ink heads 34*a* to 34*d* with respect to the sheet S1 will be described next. The control device 80 calculates the thickness of the sheet S1 input to the sheet thickness input device 86 by the operator or from the detector, and the amount of actuation of the motor 294 based on the potentiometers 292 of the ink heads 34*a* to 34*d*. The control device 80 actuates a position adjusting device (the motor 294 shown in FIG. 10) of the ink heads 34*a* to 34*d* based on the calculated value.

As the motor 294 is actuated, the motor shaft 294A rotates together with the external threaded portion 296. Upon rotation of the external threaded portion 296, the external threaded portion 296 moves in the axial direction of the motor shaft 294A by the screw action of the internal threaded portion 297 to adjust an amount of projection L from the support plate 34DP. Note that the position adjustment operation of the ink heads 34*a* to 34*d* is performed while the ink heads 34*a* to 34*d* are at the retreat position (FIG. 8) prior to a printing operation.

After the amount of projection L from the support plate 34DP of the external threaded portion 296 is adjusted, nozzle attaching/detaching devices (air cylinders 276 and 278) are actuated from the retreat position. With this operation, the support plate 34DP moves in a direction coming close to the printing cylinder 33, together with the ink heads 34*a* to 34*d* and inkjet nozzle adjusting devices 275 and 277. During this moving operation, the engagement hole 298B of the first engaging member 298 engages with the guide pins 271B and 272B of the second engaging members 271 and 272, respectively. The lower end face of the first engaging member 298 is pressed by the upper end faces of the main bodies 271A and 272A of the second engaging members 271 and 272.

By engagement between the engagement hole 298B and the guide pins 271B and 272B, and pressing of the lower end face of the first engaging member 298 against the upper end faces of the main bodies 271A and 272A, the ink heads 34*a* to 34*d* are integrally fixed to the pair of frames 3*a* through the support plate 34DP. At this time, the positions of the ink heads 34*a* to 34*d* with respect to the upper end faces of the main bodies 271A and 272A are adjusted by adjusting the amount of projection L, so the positions of the ink heads 34*a* to 34*d* with respect to the printing cylinder 33 are adjusted. With this operation, the distance between the sheet S1 and the distal ends of the ink heads 34*a* to 34*d* is adjusted to a predetermined distance.

Therefore, even when the thickness of the sheet S1 is changed, the distance between the sheet S1 and the ink heads 34*a* to 34*d* is adjusted to maintain their minute interval. As a result, discharged ink can be adhered onto the sheet S1 with high accuracy to allow high-quality printing.

The operation of the smoothing roller 51 will be described next. The sheet S1 transferred from the feed-side transfer cylinder 32 and reversing swing arm shaft pregripper 31*b* onto the printing cylinder 33 is pressed by the smoothing roller 51 on the upstream side of the suction start position 33*i* in the rotation direction of the printing cylinder 33.

The smoothing roller 51 rotates with rotation of the printing cylinder 33 while the sheet S1 is pressed, and the contact portions of the projecting portions 51CL and 51CR of the smoothing portion 51L formed in a spiral shape with respect to the sheet S1 gradually change from the center to the right and left end portions. Also, as the projecting portions 51CL and 51CR of the smoothing portions 51L and 51R deform from the central portion to the right and left end sides upon pressing against the sheet S1, the sheet S1 spreads in its widthwise direction.

The smoothing roller 51 rotates at a circumferential speed lower than the conveyance speed of the sheet S1 while being braked by the brake shoe 56A. With this operation, the sheet S1 is conveyed while being smoothed by the smoothing roller 51, and spreads in the sheet conveyance direction.

With this operation, the sheet S1 is stretched in the sheet widthwise direction and sheet conveyance direction by the smoothing roller 51, and is therefore brought into tight contact with the support surfaces 33*d*, 33*e*, and 33*f* by the suction force from the suction holes 33*g* at the suction start position 33*i* immediately after smoothing. In this manner, by sucking the sheet S1 immediately after smoothing, the entire surface of the sheet S1 can be brought into tight contact with the support surfaces 33*d*, 33*e*, and 33*f* with neither wrinkling nor floating, so the printing accuracy of the inkjet nozzle portion 34 can be improved.

Also, as the knobbed adjusting bolt 55 is operated, the pressing force acting on the shaft portion 51B of the smoothing roller 51 of the brake shoe 56A is changed through the leaf spring 59 and brake plate 56 by the knobbed adjusting bolt 55, so the braking force acting on the smoothing roller 51 is adjusted. This allows pressing by an appropriate pressing force in accordance with the thickness and material of the sheet S1, and, in turn, allows optimum smoothing of the sheet S1.

The operation of the sheet conveyance failure detection device 99 will be described next. The entire surface of the sheet S1 is brought into tight contact with the support surfaces 33*d*, 33*e*, and 33*f* by the smoothing roller 51 with neither wrinkling nor floating. However, if wrinkling, floating, or corner bending occurs due to any cause, the control device 80 determines that a conveyance failure has occurred in the sheet S1, based on the detection output of the sheet conveyance failure detection device 99. The control device 80 stops a driving motor 97 to stop the printing cylinder 33, and actuates the air cylinders 276 and 278. As the air cylinders 276 and 278 are actuated, the support plate 34DP moves in a direction away from the printing cylinder 33, together with the ink heads 34*a* to 34*d* and inkjet nozzle adjusting devices 275 and 277. With this operation, the ink heads 34*a* to 34*d* of the inkjet nozzle portion 34 move from the printing position to the retreat position.

The sheet S1 in which a conveyance failure has occurred as rotation of the printing cylinder 33 is stopped is prevented from being conveyed to the inkjet nozzle portion 34. Also, by moving the ink heads 34*a* to 34*d* to the retreat position to separate them from the printing cylinder 33, a sheet S1 with a conveyance failure and the ink heads 34*a* to 34*d* are prevented from interfering with each other. This makes it possible to prevent damage to the ink heads 34*a* to 34*d*. Also, the control device 80 controls the ink heads 34*a* to 34*d* so as not to discharge ink, based on the detection result obtained by the sheet conveyance failure detection device 99.

The printing cylinder 33 is rotated by the driving motor 97 while the ink heads 34*a* to 34*d* are moved to the retreat position, based on the operation of a discharge instruction switch 98 by the operator.

Further, the control device 80 controls the conveyance path switching device regardless of the selected printing mode to discharge the sheet S1, supplied from the sheet feed device 2, onto the pile board 41 through the printing cylinder 33, delivery-side transfer cylinder 36, delivery-side transfer cylinder 37, delivery cylinder 38, and delivery belt 40. Therefore, all sheets S1 supplied from the sheet feed device 2 at the time point of sheet conveyance failure detection are discharged onto the pile board 41. This facilitates the discharge operation of sheets S1 including a sheet S1 having a conveyance failure. In this discharge operation, the sheet S1 does not interfere with the ink heads 34*a* to 34*d*, so damage to the ink heads 34*a* to 34*d* is prevented.

The operation of the sheet presence/absence detection device 93 will be described next. The control device 80 detects the presence/absence of a sheet S1 at the timing at which the sheet S1 passes through the sheet presence/absence detection device 93 and, more specifically, the timing at which the gripper devices 33*a* to 33*c* or support surfaces 33*d* to 33*f* are opposed to the sheet presence/absence detection device 93, based on a phase signal from a rotary encoder 94. In this embodiment, since the printing cylinder 33 has the three gripper devices 33*a* to 33*c* and three support surfaces 33*d* to 33*f*, it is detected three times during 360° rotation.

If the single-sided printing mode is selected, the sheet S1 is gripped by all of the gripper devices 33*a* to 33*c* of the printing cylinder 33. Hence, the sheet presence/absence detection device 93 detects the presence of sheets S1 at all detection timings, and outputs the detection results to the control device 80.

The control device 80 turns on the ink drying lamp 35 at the timing at which the leading edge of the sheet S1 detected by the sheet presence/absence detection device 93 is opposed to the ink drying lamp 35, based on a phase signal from the rotary encoder 94 and the detection result obtained by the sheet presence/absence detection device 93. Also, the control device 80 turns off the ink drying lamp 35 at the timing at which the trailing edge of the sheet S1 passes through the ink drying lamp 35.

On the other hand, if the double-sided printing mode is selected, the printing cylinder 33 receives only a sheet S1 intermittently supplied from the sheet delivery device 4 at the start of printing, so it conveys the sheet S1 while the sheet S1 is alternately gripped by the gripper devices 33*a* to 33*c*. The sheet presence/absence detection device 93 detects the presence of a sheet S1 at the passage timing of the gripper device 33*a* which holds the sheet S1. At the passage timing of the gripper device 33*b* which holds no sheet S1, the presence of a sheet S1 is not detected (or the absence of a sheet S1 is detected). The presence of a sheet S1 is detected at the passage timing of the gripper device 33*c* which holds the sheet S1. With this operation, the sheet presence/absence detection device 93 alternately detects the presence/absence of a sheet S1, and outputs the detection results to the control device 80.

The control device 80 turns on the ink drying lamp 35 at the timing, at which the leading edge of the sheet S1 held by the gripper device 33*a* is opposed to the ink drying lamp 35, based on a phase signal from the rotary encoder 94, and the detection result obtained by the sheet presence/absence detection device 93. Also, the ink drying lamp 35 is turned off at the timing at which the trailing edge of the sheet S1 passes through the ink drying lamp 35.

When the gripper device 33*b* which holds no sheet S1, and the support surface 33*d* pass through the ink drying lamp 35, the ink drying lamp 35 is kept OFF. The ink drying lamp 35 is turned on at the timing at which the leading edge of the sheet S1 held by the gripper device 33*c* is opposed to the ink drying lamp 35. Also, the ink drying lamp 35 is turned off at the timing at which the trailing edge of the sheet S1 passes through the ink drying lamp 35.

When the operation proceeds in the double-sided printing mode, the sheet S1 printed on its obverse surface is transferred onto the printing cylinder 33 while it is turned by the reversing swing arm shaft pregripper 31*b*. With this operation, the printing cylinder 33 conveys the sheet S1 while the gripper devices 33*a*, 33*b*, and 33*c* alternately hold a sheet S1 intermittently supplied from the sheet delivery device 4, and a sheet S1 received from the reversing swing arm shaft pregripper 31*b*. At this time, since the sheet S1 is gripped by all the gripper devices 33*a* to 33*c* of the printing cylinder 33, it is detected by the sheet presence/absence detection device 93 at all detection timings. Based on the detection results, the control device 80 turns on the ink drying lamp 35 at the timing at which the leading edge of the sheet S1 is opposed to the ink drying lamp 35, and turns off the ink drying lamp 35 at the timing at which the trailing edge of the sheet S1 passes through the ink drying lamp 35.

Immediately before the end of the operation in the double-sided printing mode, supply of the sheet S1 from the sheet delivery device 4 is stopped, and the printing cylinder 33 receives the sheet S1 from only the reversing swing arm shaft pregripper 31*b*. At this time, the printing cylinder 33 conveys the sheet S1 while the sheet S1 is alternately gripped by the gripper devices 33*a* to 33*c*. The sheet presence/absence detection device 93 alternately detects the presence/absence of a sheet S1, and the control device 80 turns on the ink drying lamp 35 while the sheet S1 is opposed to the ink drying lamp 35, based on the detection result. Also, the ink drying lamp 35 is kept OFF when the gripper devices 33*a* to 33*c* and support surfaces 33*d*, 33*e*, and 33*f* which hold no sheet S1 pass through the ink drying lamp 35.

With this operation, the ink drying lamp 35 is turned on while being opposed to the sheet S1, so wasteful power consumption is suppressed.

After the end of printing, in the maintenance operation of the ink heads 34*a* to 34*d*, the ink heads 34*a* to 34*d* positioned at the retreat position (FIG. 8) are moved to the maintenance position (FIG. 9) along the guide rail 281. At the maintenance position, the ink heads 34*a* to 34*d* are moved outside the frames 3*a*, so a maintenance operation can be easily performed to considerably reduce the operator's burden.

The above-mentioned digital printing apparatus 1 performs a digital printing process on the obverse and reverse surfaces of the sheet S1 using the common printing cylinder 33 and common inkjet nozzle portion 34. This allows a more efficient double-sided printing process on the sheet S1 with space saving, compared to the case wherein a printing cylinder and inkjet nozzle portion for a reverse printing process are provided separately.

Also, the sheet S1 is sequentially transferred onto the feed-side transfer cylinder 32, printing cylinder 33, delivery-side transfer cylinders 36 and 37, pre-reversal double-diameter cylinder 39, and reversing swing arm shaft pregripper 31*b* using only gripper devices. This makes it possible to obtain high registration accuracy and high obverse/reverse registration accuracy of the obverse and reverse surfaces of the sheet S1 in the conveyance direction or widthwise direction of the sheet S1, thus improving the printing quality of the sheet S1.

Further, in the digital printing unit 3, a triple-diameter cylinder is used for the printing cylinder 33, so the feed-side transfer cylinder 32, inkjet nozzle portion 34, ink drying lamp 35, delivery-side transfer cylinders 36 and 37, delivery cylinder 38, pre-reversal double-diameter cylinder 39, and reversing swing arm shaft pregripper 31*b* can be efficiently arranged around the printing cylinder 33 while keeping the size of the printing apparatus small.

Especially, the digital printing unit 3 uses the delivery-side transfer cylinders 36 and 37 commonly to obverse and reverse printing processes, so the digital printing apparatus 1 capable of double-sided printing can be downsized.

<Other Embodiments>

Although the inkjet nozzle portion 34 of four colors is used in the above-mentioned embodiment, the present invention is not limited to this, and an inkjet nozzle portion of less than or more than four colors may be used.

Also, although the sheet reversal path is formed by the delivery-side transfer cylinders 36 and 37, pre-reversal double-diameter cylinder 39, and reversing swing arm shaft pregripper 31*b* in the above-mentioned embodiment, the sizes and number of cylinders are not limited to those in this embodiment as long as the printing apparatus is formed by only cylinders and swing arm shaft pregrippers with gripper devices. That is, the printing apparatus need only be configured to convey the sheet S1 by gripping changes of only gripper devices. Although each of the delivery-side transfer cylinders 36 and 37 and pre-reversal double-diameter cylinder 39 has one griper device in the sheet reversal path, one cylinder may be provided with a plurality of gripper devices.

Moreover, although the printing cylinder 33 implemented by a triple-diameter cylinder is used as a printing cylinder in the above-mentioned embodiment, the present invention is not limited to this. For example, a printing cylinder implemented by a quadruple-diameter cylinder may be used when, for example, the inkjet nozzle portion 34 of four colors is changed to that of, for example, six colors.

In the above-mentioned embodiment, the continuous supply valve 26 and intermittent supply valve 27 of the sheet feed device 2 are applied to the single- and double-sided printing modes. The present invention is not limited to this, and the same valve may be used in two modes to control the opening/closing of this valve by the control device 80 at different timings (periods).

What is claimed is:

1. A digital printing apparatus comprising:

a sheet supply device which supplies sheets one by one at a predetermined period;

a printing cylinder which includes at least one gripper device that grips and holds the sheet, and conveys the sheet while one edge of the sheet supplied from said sheet supply device is held by said at least one gripper device;

an inkjet nozzle portion which discharges an ink droplet onto the sheet conveyed by said printing cylinder, and prints on the sheet;

a sheet delivery device which discharges the sheet after end of printing by said inkjet nozzle portion;

conveyance devices which include a plurality of gripper devices including one reversing gripper device that grips and holds the other edge of the sheet, convey the sheet printed on one surface, which is received from said printing cylinder in a double-sided printing mode, while sequentially transferring the sheet by gripping changes by said plurality of gripper devices, and supply to said printing cylinder the sheet turned by reversing an obverse/reverse surface of the sheet by said reversing gripper device in the process of conveyance;

an upstream sheet conveyance device which transfers the sheet from said sheet supply device to said at least one gripper device of said printing cylinder;

a sheet presence/absence detection device which is provided on a downstream side, in a sheet conveyance direction, of a sheet reception position at which the sheet is received from said upstream sheet conveyance device of said printing cylinder, and on an upstream side, in the sheet conveyance direction, of a printing position at which printing is performed by said inkjet nozzle portion, and detects presence/absence of a sheet on said printing cylinder;

a drying device which is provided on an upstream side of the printing position of said printing cylinder in the sheet conveyance direction, and dries ink printed on the sheet;

a phase detection device which detects a rotary phase of said printing cylinder; and a control device which controls said drying device based on the outputs from said sheet presence/absence detection device and said phase detection device, so as to stop a drying operation when a support surface which supports no sheet on said printing cylinder is opposed to said drying device.

2. A digital printing apparatus comprising:

a sheet supply device which supplies sheets one by one at a predetermined period;

a printing cylinder which includes at least one gripper device that grips and holds the sheet, and conveys the sheet while one edge of the sheet supplied from said sheet supply device is held by said at least one gripper device;

an inkjet nozzle portion which discharges an ink droplet onto the sheet conveyed by said printing cylinder, and prints on the sheet;

a sheet delivery device which discharges the sheet after end of printing by said inkjet nozzle portion;

conveyance devices which include a plurality of gripper devices including one reversing gripper device that grips and holds the other edge of the sheet, convey the sheet printed on one surface, which is received from said printing cylinder in a double-sided printing mode, while sequentially transferring the sheet by gripping changes by said plurality of gripper devices, and supply to said printing cylinder the sheet turned by reversing an obverse/reverse surface of the sheet by said reversing gripper device in the process of conveyance;

an upstream sheet conveyance device which transfers the sheet from said sheet supply device to said at least one gripper device of said printing cylinder;

a sheet conveyance failure detection device which is provided on a downstream side, in a sheet conveyance direction, of a sheet reception position at which the sheet is received from said upstream sheet conveyance device of said printing cylinder, and on an upstream side, in the sheet conveyance direction, of a printing position at which printing is performed by said inkjet nozzle portion, and detects a conveyance failure of the sheet;

a nozzle head moving device which brings said inkjet nozzle portion close to said printing cylinder or separates said inkjet nozzle portion from said printing cylinder, said nozzle head moving device including an inkjet nozzle attaching/detaching device which moves said inkjet nozzle portion between a printing position at which said inkjet nozzle portion comes close to said printing cylinder to print on the sheet, and a retreat position at which said inkjet nozzle portion retreats radially outside said printing cylinder; and a control device which controls said nozzle attaching/detaching device based on the detection output of said sheet conveyance failure detection device during printing to move said inkjet nozzle portion from the printing position to the retreat position.

3. An apparatus according to claim 2, further comprising:

sheet thickness input/detection means which detects or receives a thickness of the sheet, wherein said nozzle head moving device further comprises a head position adjusting device which adjusts a position of said inkjet nozzle portion with respect to said printing cylinder at the printing position, and said control device controls said head position adjusting device based on the sheet thickness output from said sheet thickness detection/input means to adjust a gap between said inkjet nozzle portion and the sheet conveyed by said printing cylinder.

* * * * *